US011220106B2

(12) United States Patent
Miura et al.

(10) Patent No.: US 11,220,106 B2
(45) Date of Patent: Jan. 11, 2022

(54) LIQUID DISCHARGE APPARATUS AND METHOD FOR ADJUSTING DISCHARGE HEAD IN THE LIQUID DISCHARGE APPARATUS

(71) Applicants: Shogo Miura, Kanagawa (JP); Kohhei Yamaguchi, Kanagawa (JP); Kohtaroh Ikegami, Kanagawa (JP)

(72) Inventors: Shogo Miura, Kanagawa (JP); Kohhei Yamaguchi, Kanagawa (JP); Kohtaroh Ikegami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/104,541

(22) Filed: Nov. 25, 2020

(65) Prior Publication Data

US 2021/0162737 A1 Jun. 3, 2021

(30) Foreign Application Priority Data

Nov. 29, 2019 (JP) ..... JP2019-216839

(51) Int. Cl.
*B41J 2/145* (2006.01)
*B41J 2/045* (2006.01)

(52) U.S. Cl.
CPC ..... *B41J 2/04526* (2013.01); *B41J 2/04581* (2013.01); *B41J 2/145* (2013.01)

(58) Field of Classification Search
CPC .... B41J 2/04526; B41J 2/04581; B41J 2/145; B41J 25/003; B41J 25/001; B41J 3/407; D05C 11/24
See application file for complete search history.

(56) References Cited

U.S. PATENT DOCUMENTS

2016/0107467 A1* 4/2016 Nakata ..... B41J 2/2135 347/19

FOREIGN PATENT DOCUMENTS

| | | |
|---|---|---|
| JP | 6-292782 | 10/1994 |
| JP | 6-305129 | 11/1994 |
| JP | 2015-123655 | 7/2015 |

* cited by examiner

*Primary Examiner* — Lamson D Nguyen
(74) *Attorney, Agent, or Firm* — IPUSA, PLLC

(57) ABSTRACT

A liquid discharge apparatus includes a discharge head having a nozzle row, a conveyor is configured to convey a discharge target medium, a head mover configured to move the discharge head in an orthogonal direction, a head rotator configured to rotate the discharge head, and circuitry configured to perform a position setting operation to cause the head mover to move the discharge head to a position in the orthogonal direction, a discharging operation to cause the discharge head to discharge a liquid at the position, a medium conveying operation to cause the conveyor to convey the discharge target medium, and a changing operation to cause the head mover to change the position of the discharge head, and cause the head rotator to rotate the discharge head based on a length of droplets of the liquid landed on the discharge target medium by the above-described operations.

12 Claims, 19 Drawing Sheets

LIQUID DISCHARGE APPARATUS AND METHOD FOR ADJUSTING DISCHARGE HEAD IN THE LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-216839, filed on Nov. 29, 2019, in the Japan Patent Office, the entire disclosure of which is hereby incorporated by reference herein.

BACKGROUND

Technical Field

Embodiments of the present disclosure relate to a liquid discharge apparatus that discharges liquid to a linear or strip-shaped discharge target medium such as a thread, and a method for adjusting a discharge head in the liquid discharge apparatus.

Background Art

Various types of inkjet type image forming apparatus have generated variation in the installation position of each inkjet head that discharges ink, and therefore caused deviation of the landing position of ink discharged from the inkjet head. In order to address this inconvenience, such inkjet type image forming apparatus provides a technique in which, when ink is discharged onto a recording medium such as paper, deviation of the landing position is read and fed back to grasp the position of the discharge head and the position of the nozzle and adjust the discharge timing and the position of the discharge head, so as to eliminate the deviation of the landing position.

However, if a coloring apparatus that a linear object such as a thread thinner and narrower than a paper material adjusts the landing droplets from the discharge heads in the same way that an image forming apparatus corrects the positional deviation of landing droplets, in a case in which the discharge head has the positional deviation or is tilted with respect to the linear direction, the droplet may not land on the linear object that is a landing target object. If the liquid does not land on the linear object, in the subsequent stage, the landing droplet is not read and fed back, resulting in a failure of correction of the position of the landing droplet.

SUMMARY

Embodiments of the present disclosure described herein provide a novel liquid discharge apparatus including a discharge head, a conveyor, a head mover, a head rotator, and circuitry. The discharge head has a nozzle row in which a plurality of nozzles are arranged to discharge a liquid. The conveyor is configured to convey a discharge target medium in parallel with a direction of arrangement of the nozzle row of the discharge head. The head mover is configured to move the discharge head in an orthogonal direction to a medium conveyance direction of the discharge target medium. The head rotator is configured to rotate the discharge head about an axial direction in which the liquid is discharged from each nozzle. The circuitry is configured to move and rotate the discharge head, and perform a position setting operation to cause the head mover to move the discharge head to a position in the orthogonal direction, a discharging operation to cause the discharge head to discharge a liquid from each nozzle of the nozzle row of the discharge head at the position to which the discharge head is moved by the position setting operation, a medium conveying operation to cause the conveyor to convey the discharge target medium by a distance equal to or greater than a length of the nozzle row, and a changing operation to cause the head mover to change the position of the discharge head set in the position setting operation. The circuitry is configured to cause the head rotator to rotate the discharge head based on a length of droplets of the liquid landed on the discharge target medium by the position setting operation, the discharging operation, the medium conveying operation, and the changing operation.

Further, embodiments of the present disclosure described herein provide a method for adjusting a discharge head in a liquid discharge apparatus that includes the discharge head, a conveyor, a head mover, and a head rotator. The method includes moving the discharge head with the head mover to a position in an orthogonal direction to a medium conveyance direction of a discharge target medium, discharging liquid from each nozzle of a nozzle row of the discharge head at the position to which the discharge head is moved by the moving, conveying the discharge target medium with the conveyor by a distance equal to or greater than a length of the nozzle row, changing, with the head mover, the position of the discharge head set in the moving, and rotating the discharge head with the head rotator, based on a length of a droplet landing area of droplets of the liquid landed on the discharge target medium by the moving, the discharging, the conveying, and the changing.

BRIEF DESCRIPTION OF THE SEVERAL VIEWS OF THE DRAWINGS

Exemplary embodiments of this disclosure will be described in detail based on the following figures, wherein.

Figure 1:
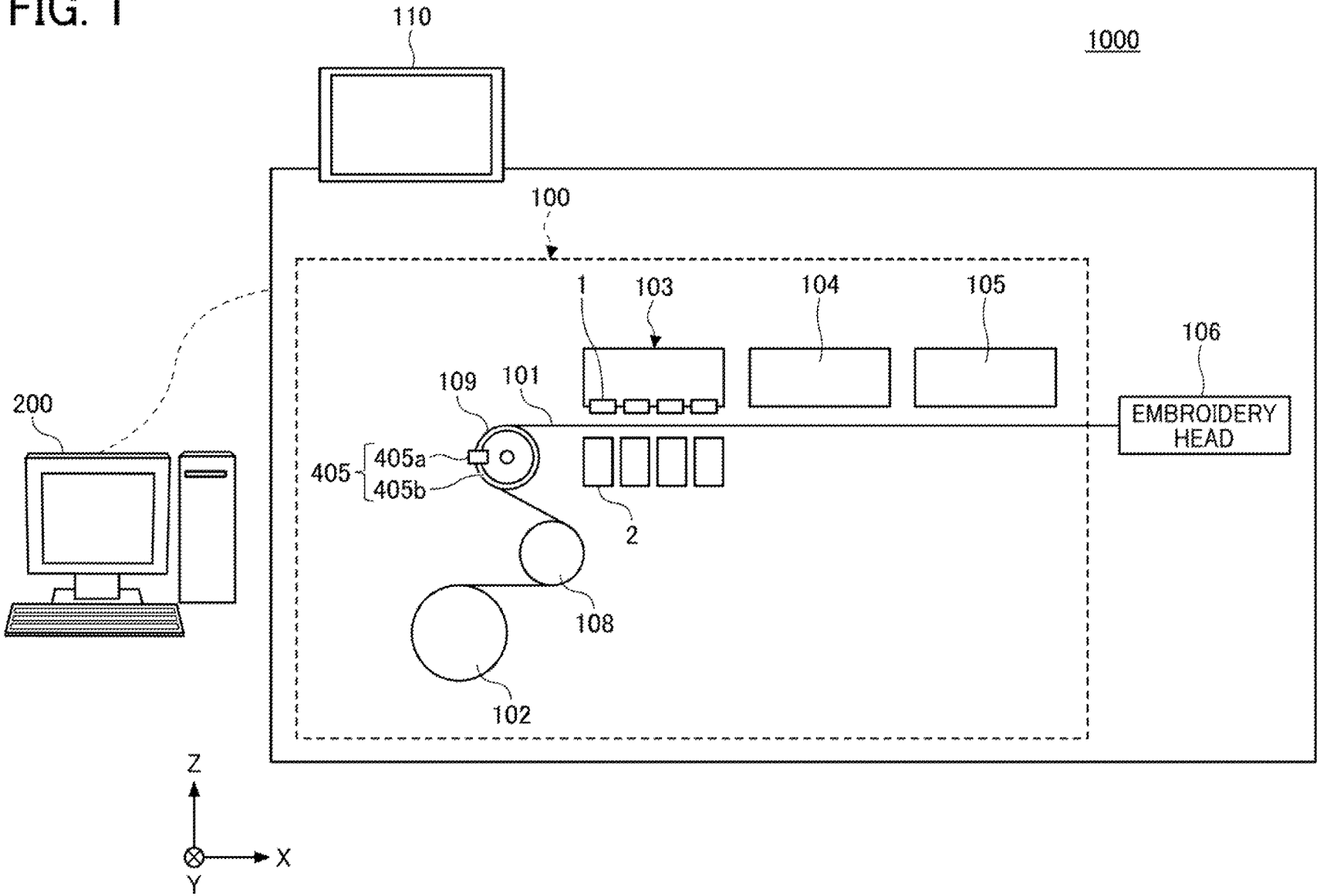
FIG. 1 is a schematic view illustrating an example of a thread coloring-embroidering system incorporating a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

A description is given of a liquid discharge apparatus and a discharge head adjustment method, according to an embodiment of the present disclosure with reference to drawings. In each drawing below, the same configuration shares the same reference numeral and the overlapped description is omitted.

Overall Configuration

Figure 2:
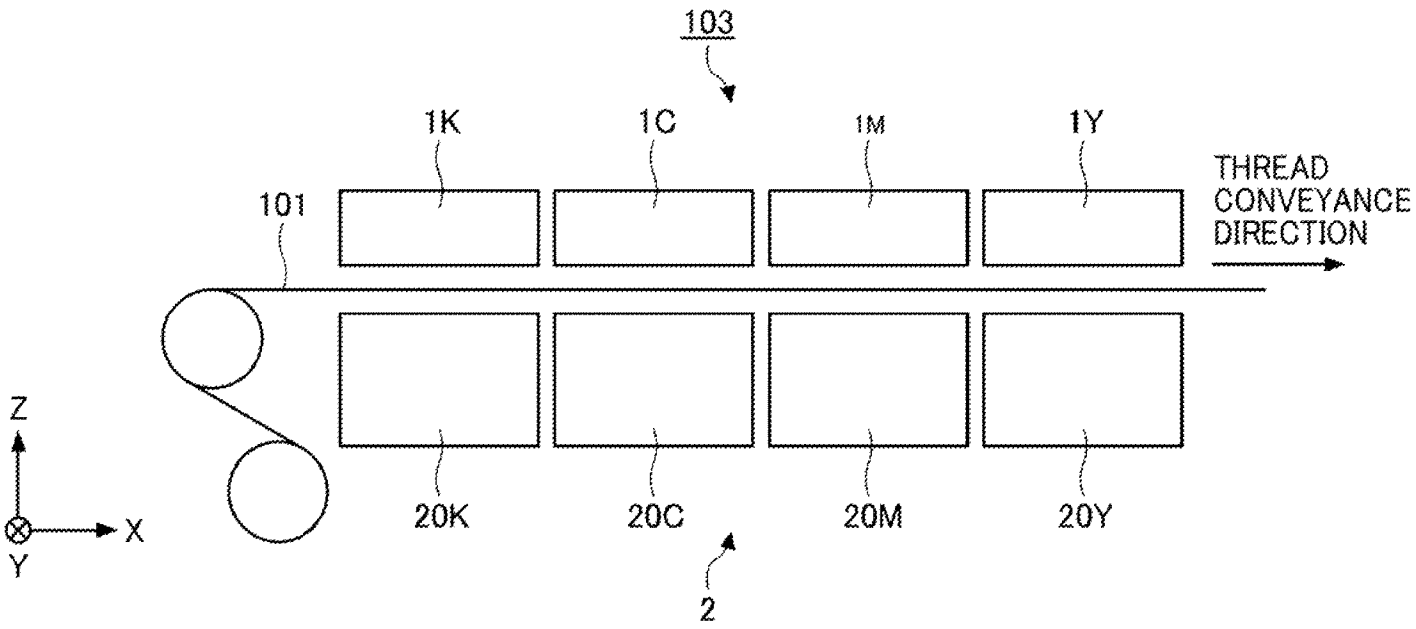
FIG. 2 is a schematic side view illustrating a liquid applying device provided in the liquid discharge apparatus according to an embodiment of the present disclosure.
Figure 3:
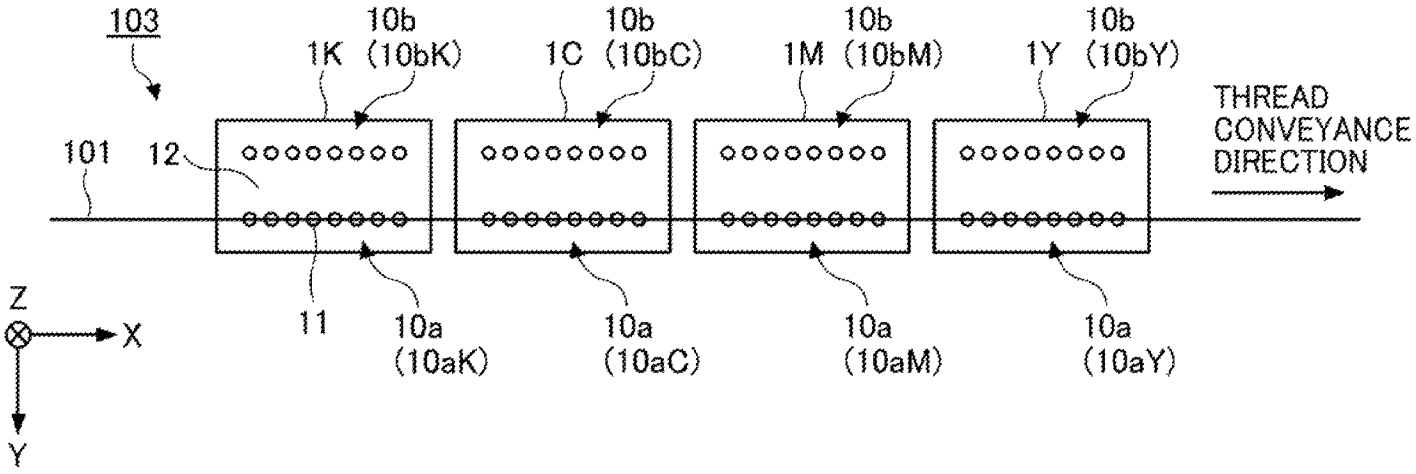
FIG. 3 is a schematic view illustrating the lower face of the liquid applying device according to an embodiment of the present disclosure.

Now, a description is given of a thread coloring-embroidering apparatus including a liquid discharge apparatus according to an embodiment of the present disclosure, with reference to FIGS. 1 to 3.

FIG. 1 is a schematic view illustrating an example of a thread coloring-embroidering apparatus incorporating a liquid discharge apparatus according to an embodiment of the present disclosure.

FIG. 2 is a schematic side view illustrating a liquid applying device provided in the liquid discharge apparatus according to an embodiment of the present disclosure.

FIG. 3 is a schematic view illustrating the lower face of the liquid applying device according to an embodiment of the present disclosure.

As illustrated in FIG. 1, the thread coloring-embroidering apparatus 1000 is an in-line embroidering apparatus and includes a thread supplying reel 102 around which a thread 101 is wound, a liquid applying device 103, a fixing device 104, a post-processing device 105, and an embroidery head 106. The thread supplying reel 102, the liquid applying device 103, the fixing device 104, and the post-processing device 105 are included in a liquid discharge apparatus 100 according to the present embodiment. The liquid discharge apparatus 100 does not include the embroidery head 106. The liquid discharge apparatus 100 is also referred to as a coloring device.

The thread 101 is fed out from the thread supplying reel 102 and then guided by conveyance rollers 108 and 109 to be serially conveyed to the embroidery head 106.

A rotary encoder 405 is mounted on the conveyance roller 109. Hereinafter, the rotary encoder 405 may simply be referred to as the encoder 405. The encoder 405 includes an encoder wheel 405*a* and an encoder sensor 405*b*. The encoder wheel 405*a* rotates with the conveyance roller 109. The encoder sensor 405*b* reads slits of the encoder wheel 405*a*.

The liquid applying device 103 includes a plurality of heads 1 (1K, 1C, 1M, and 1Y) and a maintenance unit 2. The liquid applying device 103 discharges a liquid of a desired color onto the thread 101 that is fed out from the thread supplying reel 102. The maintenance unit 2 includes a plurality of individual maintenance units 20 (i.e., individual maintenance units 20K, 20C, 20M, and 20Y) to perform maintenance of the discharge heads 1 (i.e., the discharge heads 1K, 1C, 1M, and 1Y), respectively.

Hereinafter, the direction in which the thread 101 is conveyed from the liquid applying device 103 to the embroidery head 106 is referred to as a thread conveyance direction X, the depth direction (that is, a head movement direction) of the thread coloring-embroidering apparatus 1000 is referred to as a head movement direction Y, and the height direction (that is, the vertical direction) is referred to as a height direction Z.

With reference to FIG. 2, in the liquid applying device 103, the plurality of heads 1K, 1C, 1M, and 1Y are discharge heads that discharge droplets (ink droplets) of different colors from each other. For example, the discharge head 1Y is a head that discharges droplets of black (K), the discharge head 1C is a head that discharges droplets of cyan (C), the discharge head 1M is a head that discharges droplets of magenta (M), and the discharge head 1Y is a head that discharges droplets of yellow (Y). Note that this order of colors is an example and that the colors may be disposed at respective positions different from this description.

The individual maintenance units 20K, 20C, 20M, and 20Y are disposed below the liquid applying device 103 so as to face each of the discharge heads 1K, 1C, 1M, and 1Y, respectively.

Here, as illustrated in FIG. 3, the discharge head 1K has a nozzle face 12 on which nozzle rows 10*a* and 10*b* are formed. In each of the nozzle rows 10*a* and 10*b*, a plurality of nozzles 11 that discharge liquid droplets are arranged in a row. Each of the discharge heads 1K, 1C, 1M, and 1Y is disposed such that the direction of each nozzle row (i.e., the arrangement of the nozzles 11 in each nozzle row) is parallel to the thread conveyance direction (thread feeding direction) of the thread 101.

In the discharge head 1K, ink droplets discharged from the nozzles 11 of one row (e.g., the nozzle row 10*a* in FIG. 3) placed directly below the thread 101 land on the thread 101 to color the thread 101. Note that FIG. 3 illustrates an example in which each head 1 has two nozzle rows, i. e., two nozzle rows 10*a* and 10*b*, on the nozzle face 12. However, the number of nozzle rows in the discharge head 1K may be one, or three or more. Note that, as illustrated in FIG. 3, the other heads 1C, 1M, and 1Y have a similar, even if not the same, structure as the structure of the discharge head 1K.

Referring back to FIG. 1, the fixing device 104 performs the fixing operation, in other words, the drying operation, to the thread 101 to which liquid that is discharged from the liquid applying device 103 is applied.

The fixing device 104 includes a heating unit, for example, an infrared irradiator and a heated air blower, so as to heat and dry the thread 101.

The post-processing device 105 includes, for example, a cleaner to clean the thread 101, a tension adjuster to adjust tension of the thread 101, a feed amount detector to detect the amount (length) of movement of the thread 101, and a lubricant applier to apply lubricant onto the surface of the thread 101.

The embroidery head 106 sews the colored thread 101 into a cloth to embroider a pattern or a design on the cloth, for example.

Further, the thread coloring-embroidering apparatus 1000 includes an operation unit 110 to which an operator, a service representative, or a user inputs data manually. In other words, the operation unit 110 receives data that is input manually by an operator, a service representative, or a user. Note that, instead of the operation unit 110 that functions as an interface portion, an external information processing device 200 to which data is input by, for example, an operator may be connected to the thread coloring-embroidering apparatus 1000.

Note that the present embodiment describes a liquid discharge apparatus is included in the thread coloring-embroidering apparatus 1000. However, the liquid discharge apparatus is not limited to the above-described thread coloring-embroidering apparatus. For example, the present disclosure may also be applied to an apparatus using a linear object such as a thread, in other words, a linear discharge target medium, to an apparatus such as a weaving machine and a sewing machine.

Also note that the term "thread" includes glass fiber thread; wool thread; cotton thread; synthetic fiber thread; metallic thread; mixed thread of wool, cotton, polymer, or metal; and linear object (linear member or continuous material) to which yarn, filament, or liquid is applied. The term "thread" also includes braided cord and flatly braided cord.

In addition to the linear object, the term "thread" further includes a belt-shaped member (continuous material) to which liquid is applied, such as rope, cable, and cord, as a discharge target medium that may be colored by ink (ink droplets). Each discharge target medium is a linear or strip-shaped medium with a narrow width and consecutively extends in the thread conveyance direction.

Figure 4:
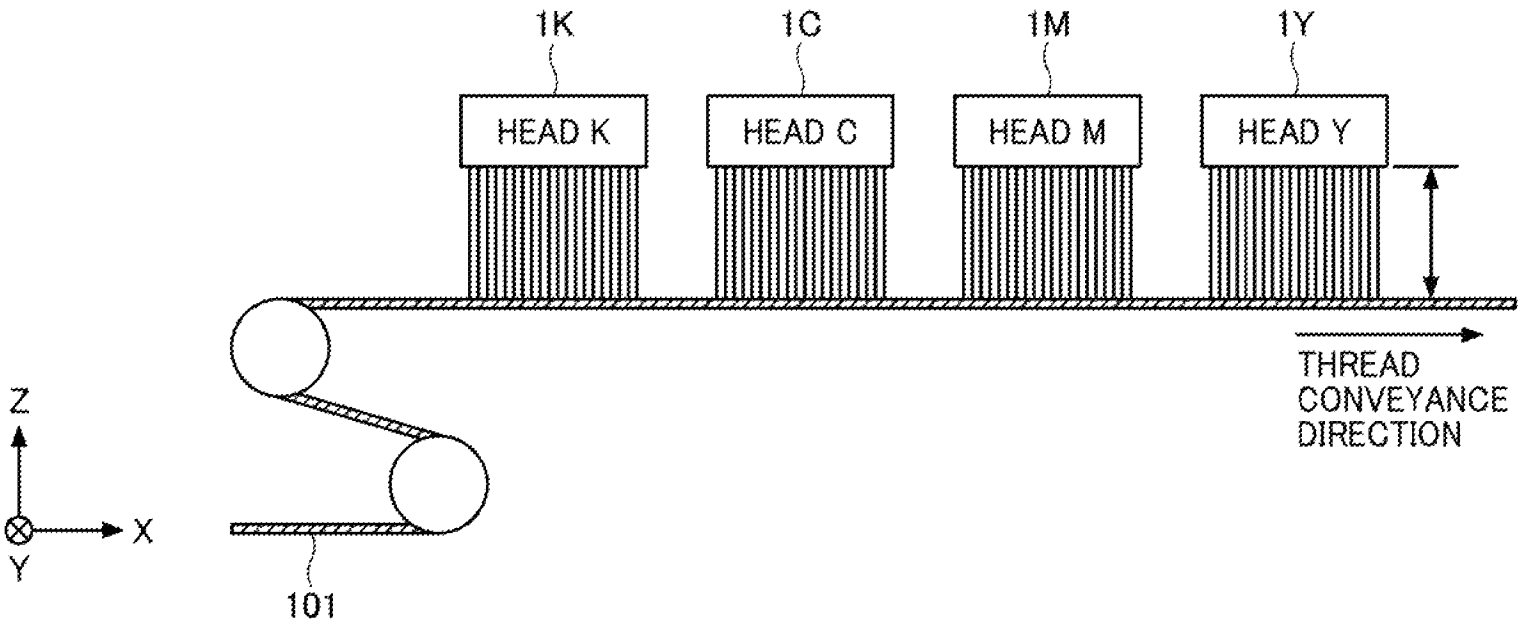
FIG. 4 is a side view illustrating the state in which a plurality of discharge heads of the liquid applying device according to the present disclosure discharges liquid from a plurality of nozzles simultaneously.

FIG. 4 is a side view illustrating the state in which the plurality of heads 1, in other words, the discharge heads 1K, 1C, 1M, and 1Y of the liquid applying device 103 according to the present disclosure discharge liquid from each of the plurality of nozzles 11 to the thread 101 simultaneously.

As illustrated in FIG. 3, the nozzle rows 10*a* of the discharge heads 1K, 1C, 1M, and 1Y are aligned directly above the thread 101 in the thread conveyance direction, along the same direction as the thread conveyance direction. Therefore, as illustrated in FIG. 4, when droplets are discharged simultaneously from the plurality of nozzles 11 of one nozzle row of the discharge heads 1K, 1C, 1M, and 1Y, that is, the nozzle rows 10*a* (i.e., the nozzle row 10*a*K, 10*a*C, 10*a*M, and 10*a*Y as illustrated in FIG. 3) of the discharge heads 1K, 1C, 1M, and 1Y, respectively, the droplets are discharged to land at different positions simultaneously on the thread 101 in the thread conveyance direction.

Head Position Shift

Next, a description is given of movement of the discharge head, with reference to FIGS. 5 to 8.

Figure 5A:
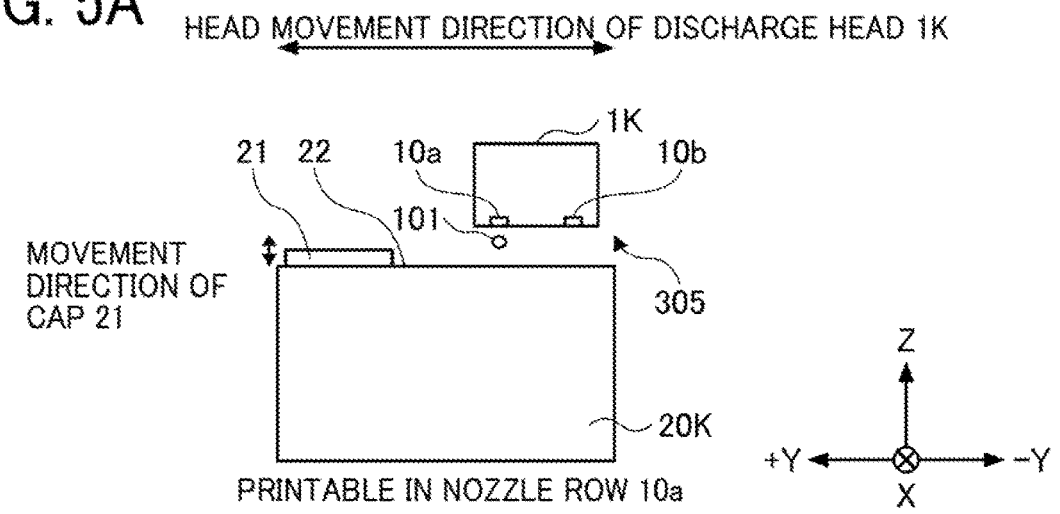
FIGS. 5A, 5B, and 5C are diagrams each for explaining that the discharge head moves in an orthogonal direction orthogonal to a thread conveyance direction in the liquid applying device according to an embodiment of the present disclosure, viewed from the orthogonal direction to the thread conveyance direction.
Figure 5B:
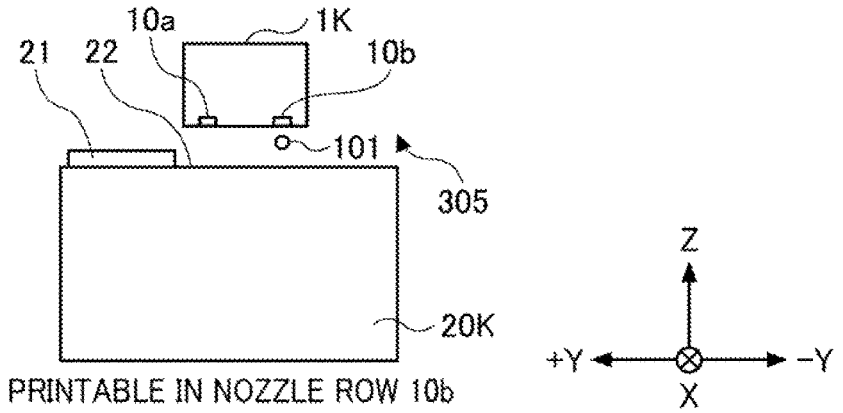
Figure 5C:
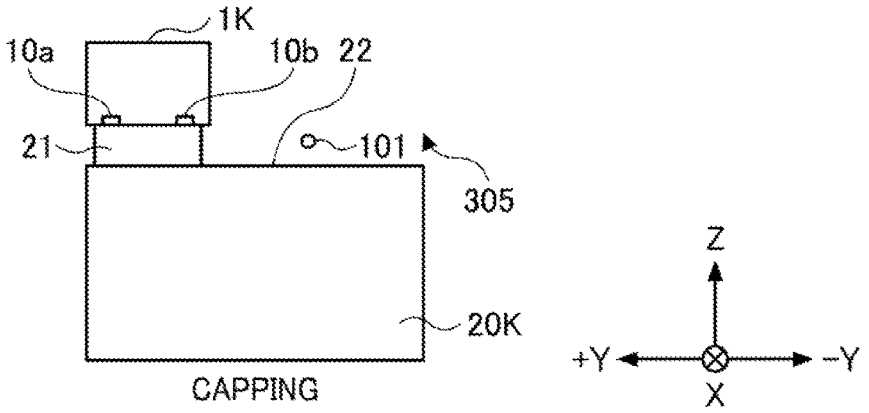

FIGS. 5A, 5B, and 5C are diagrams each for explaining the movement of the discharge head in an orthogonal direction orthogonal to the thread conveyance direction in the liquid applying device according to an embodiment of the present disclosure.

Figure 6:
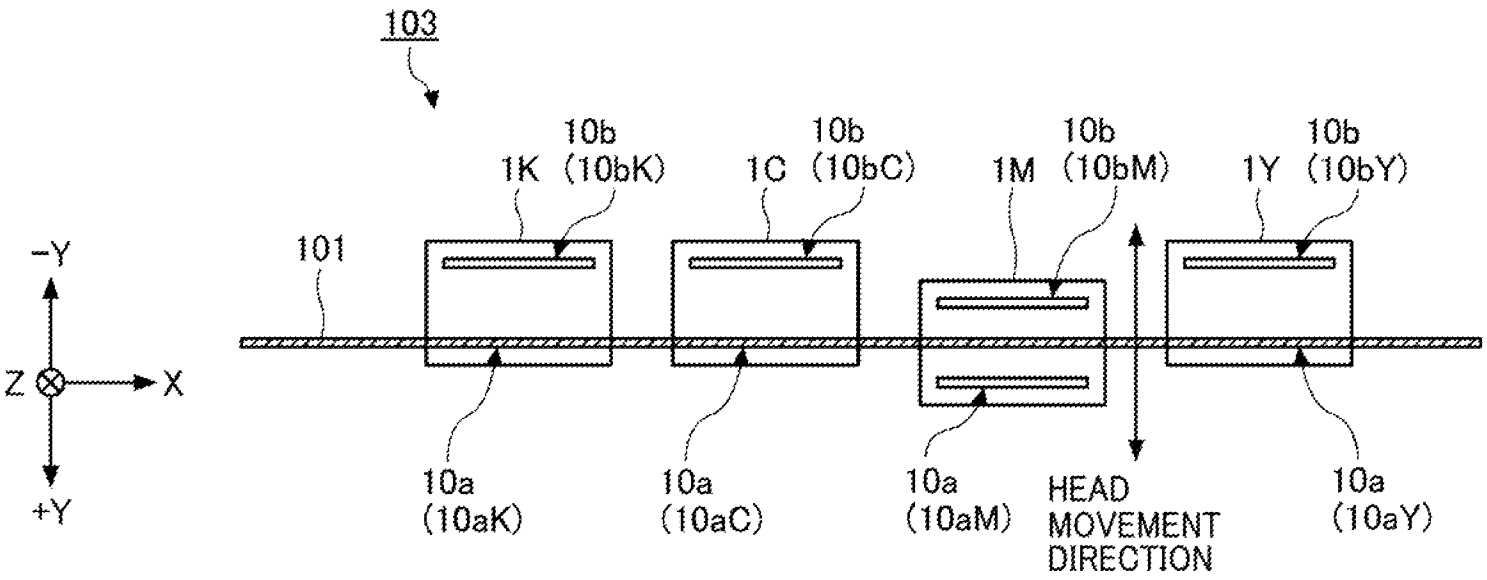
FIG. 6 is a schematic diagram illustrating the bottom of the discharge heads for explaining the movement of the discharge head in the orthogonal direction to the thread conveyance direction in the liquid applying device according to an embodiment of the present disclosure.

FIG. 6 is a schematic diagram illustrating the bottom of the discharge heads for explaining the movement of the discharge head in the orthogonal direction to the thread conveyance direction in the liquid applying device according to an embodiment of the present disclosure.

Figure 7:
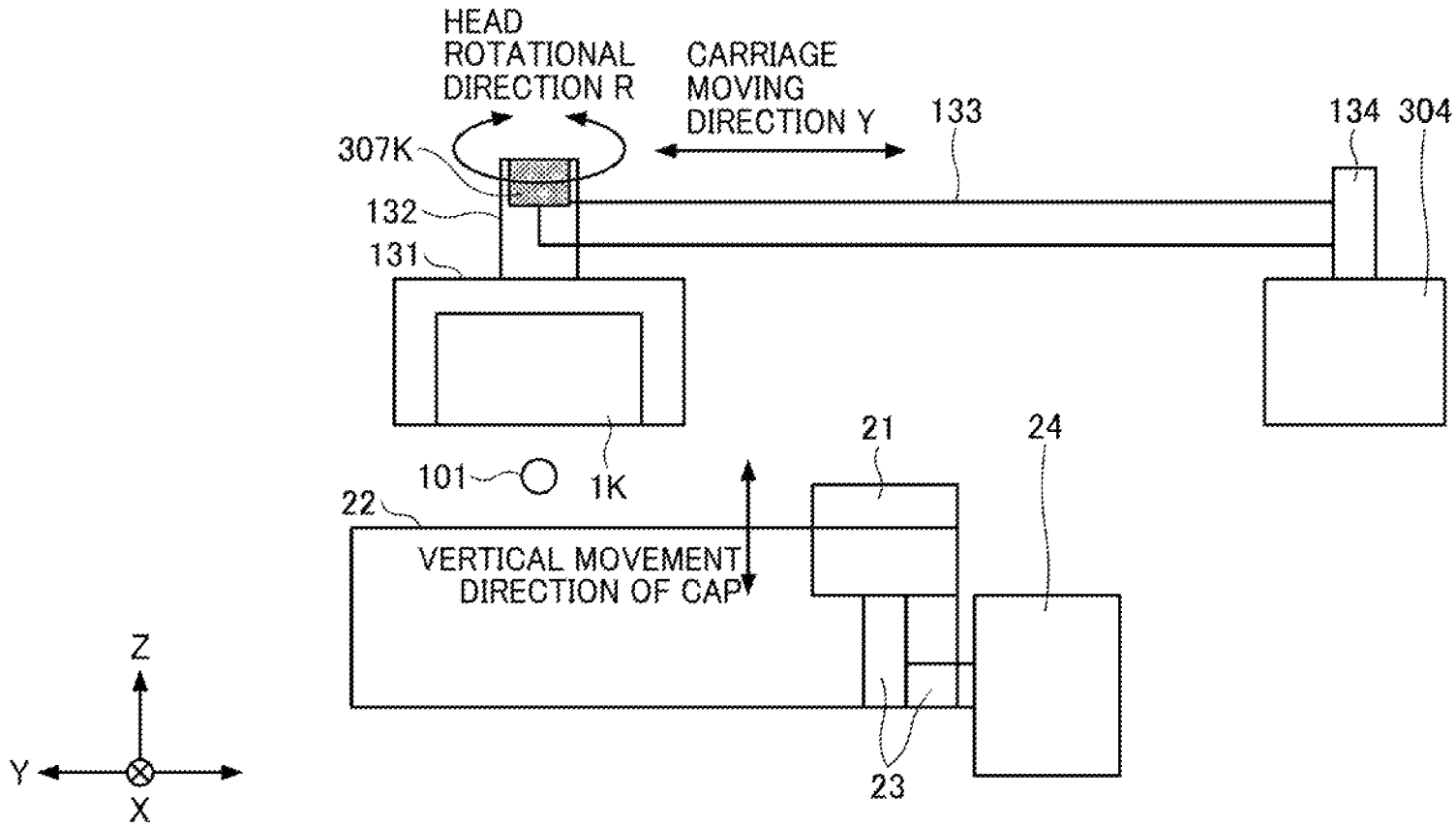
FIG. 7 is a schematic diagram illustrating the head moving device of the liquid applying device and a head moving device of a cap of a maintenance-recovery device.

FIG. 7 is a schematic diagram illustrating the head moving device of the liquid applying device and a head moving device of a cap of a maintenance-recovery device.

Figure 8:
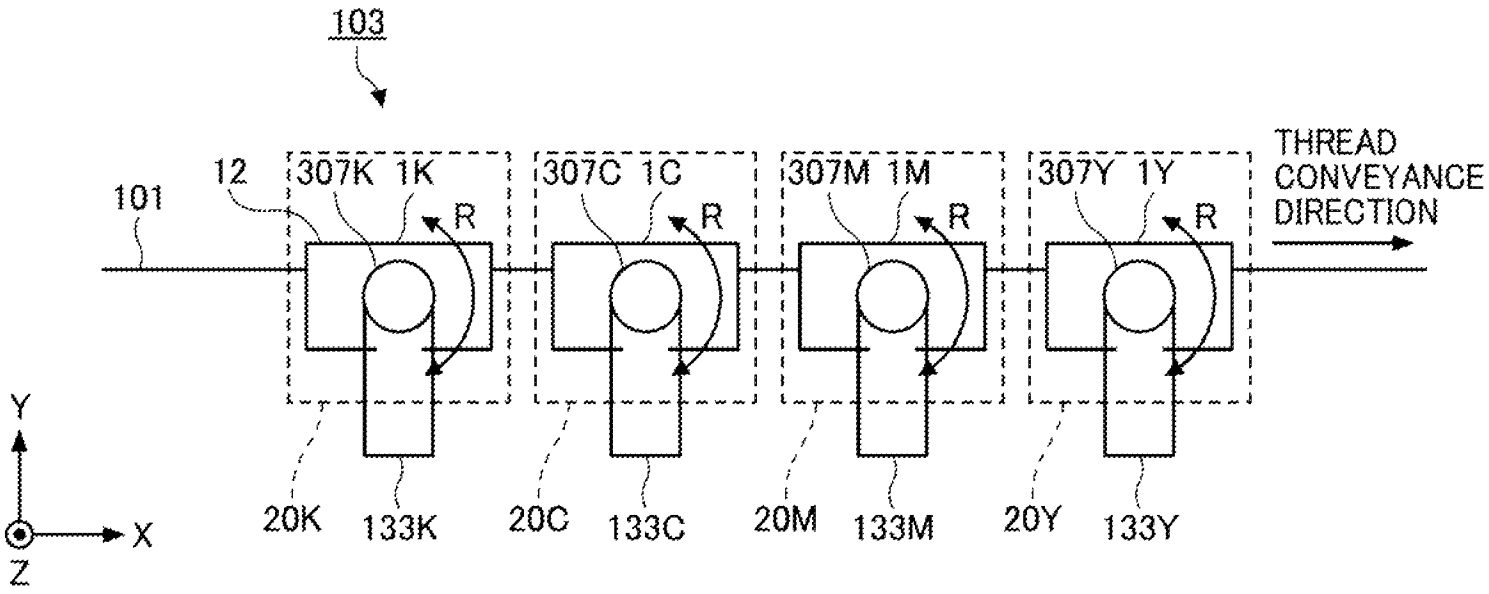
FIG. 8 is a schematic top view of the liquid applying device for explaining adjustment of inclination of each discharge head of the liquid applying device by a hear rotator.

FIG. 8 is a schematic top view of the liquid applying device for explaining an example of the head angle adjustment mechanism provided in the liquid applying device.

Specifically, FIG. 5A depicts the position of the discharge head 1K in a state in which droplets can be discharged from the nozzle row 10*a* onto the thread 101. FIG. 5B depicts the position of the discharge head 1K in a state in which droplets can be discharged from the nozzle row 10*b* onto the thread 101. FIG. 5C depicts the position of the discharge head 1K in a state in which the nozzle rows 10*a* and 10*b* are capped with the cap 21.

As illustrated in FIGS. 5A, 5B, 5C, and 6, moving the discharge head 1K in an orthogonal direction to the thread conveyance direction of the thread 101 allows discharging for coloring with the nozzle row 10*a*, discharging for coloring with the nozzle row 10*b*, and capping of the nozzle face 12 with the cap 21. The head movement direction Y of the discharge head 1 is the same direction as the depth direction of the thread coloring-embroidering apparatus 1000 illustrated in FIG. 1.

Similarly, in the other heads, the discharge heads 1K, 1C, 1M, and 1Y of the respective colors are freely movable in the head movement direction for selection of the nozzle row to be used and maintenance of the nozzle row.

Further, as illustrated in FIGS. 3, 5A, 5B, 5C, and 6, the nozzle rows 10*a* and 10*b* are aligned on the lower surface of the discharge head 1. Regarding the nozzle row that causes ink droplets to land on the thread to color the thread, the nozzle row to be appropriately used can be selectable by moving the discharge head 1 and setting the nozzle row that discharges ink droplets directly above the thread 101.

In addition to the recovery operation by capping that engages with the cap 21, the individual maintenance unit 20K also collects ink that has run off the thread 101 and has not landed on the thread 101, on a collection face 22 that is an upper surface on which the cap 21 and the thread 101 are not provided.

Note that a home position sensor (HP sensor) 305 is disposed in the individual maintenance unit 20 as a reference for movement of the discharge head 1. Further, note that FIGS. 5A, 5B, and 5C each depicts an example in which the HP sensor 305 that defines the position of the home position of the discharge head 1 is provided at the end portion of the individual maintenance unit 20. In some embodiments, the HP sensor 305 may be provided at another position in the movement direction of the discharge head 1.

Further, as illustrated in FIG. 6, the plurality of heads 1K, 1C, 1M, and 1Y move to different positions in the ±Y directions separately. Therefore, even if the positions of the nozzle rows 10*a*K, 10*a*C, and 10*a*Y are correctly set with respect to the thread 101 in the plurality of heads 1K, 1C, and 1Y, the position of the nozzle row 10*a*M of the discharge head 1M may be shifted from the correct position with respect to the thread 101.

Here, a description is given of a mechanism that moves the discharge heads 1K to 1Y in a head movement direction toward the rear of the apparatus, with reference to FIG. 7. FIG. 7 is a schematic diagram illustrating the head moving device of the liquid applying device 103 and a head moving device of the cap 21 of the maintenance unit 2.

As illustrated in FIG. 7, the discharge head 1 is supported by a movable carriage 131. The carriage 131 is supported by a hanging column 132 and an arm 133. A head moving motor 304 moves the arm 133 and an arm 134 both supporting the carriage 131, thus allowing the carriage 131 to move in a movable direction. As an example of the head movement, for example, the arm 133 itself extending in the horizontal direction may expand and contract, or the carriage 131 may be moved by changing the position of the hanging column 132 with respect to the arm 133.

Such a structure allows the discharge head 1K supported by the carriage 131 is moved to the position of the cap 21 during the standby state and is moved to the position of the thread 101 during the coloring operation.

In the individual maintenance unit 20, the cap 21 is lifted up and down by a lifting arm 23. The lifting arm 23 is driven by a motor 24. As illustrated in FIG. 5C, the cap 21 is raised to cap the discharge head 1 to prevent ink on the discharge head 1K from drying during the standby state. During the coloring operation, as illustrated in FIGS. 5A and 5B, the cap 21 is lowered for decapping.

Further, the hanging column 132 is provided with a rotation motor 307 (i.e., rotation motors 307K, 307C, 307M, and 307Y). A rotation motor 307K rotates the discharge head 1K. The hanging column 132 and the rotation motor 307K function as a head angle adjustment mechanism that adjusts the inclination of the discharge head 1K with respect to the thread 101. A detailed description of a head rotator that rotates the discharge head 1 will be described below with reference to FIG. 8.

Note that FIGS. 5A, 5B, and 5C each depicts an example in which, in the individual maintenance unit 20, the cap 21 is disposed on the rear side (+Y side) of the thread coloring-embroidering apparatus 1000. In some embodiments, in the individual maintenance unit 20, the cap 21 may be disposed on the front side (−Y side) of the thread coloring-embroidering apparatus 1000 as illustrated in FIG. 7.

Adjustment of Head Angle

As described above, FIG. 8 is a schematic top view of the liquid applying device for explaining an example of the head angle adjustment mechanism provided in the liquid applying device 103. More specifically, FIG. 8 is a schematic top view explaining adjustment of inclination of each discharge head of the liquid applying device 103 by a hear rotator.

The liquid applying device 103 includes the rotation motors 307K, 307C, 307M, and 307Y fixed on top of the discharge heads 1K, 1C, 1M, and 1Y, respectively. The rotation motors 307K, 307C, 307M, and 307Y rotate the discharge heads 1K, 1C, 1M, and 1Y in a rotational direction R, respectively. In the liquid discharge apparatus 100, when it is determined, as described below, that the discharge heads 1K, 1C, 1M, and 1Y are tilted relative to the thread 101, based on the tilt angle of the discharge heads 1K, 1C, 1M, and 1Y and the direction of inclination of the discharge heads 1K, 1C, 1M, and 1Y, the rotation motors 307K, 307C, 307M, and 307Y rotate the discharge heads 1K, 1C, 1M, and 1Y so that the discharge heads 1K, 1C, 1M, and 1Y are placed parallel to the thread 101.

Figure 12:
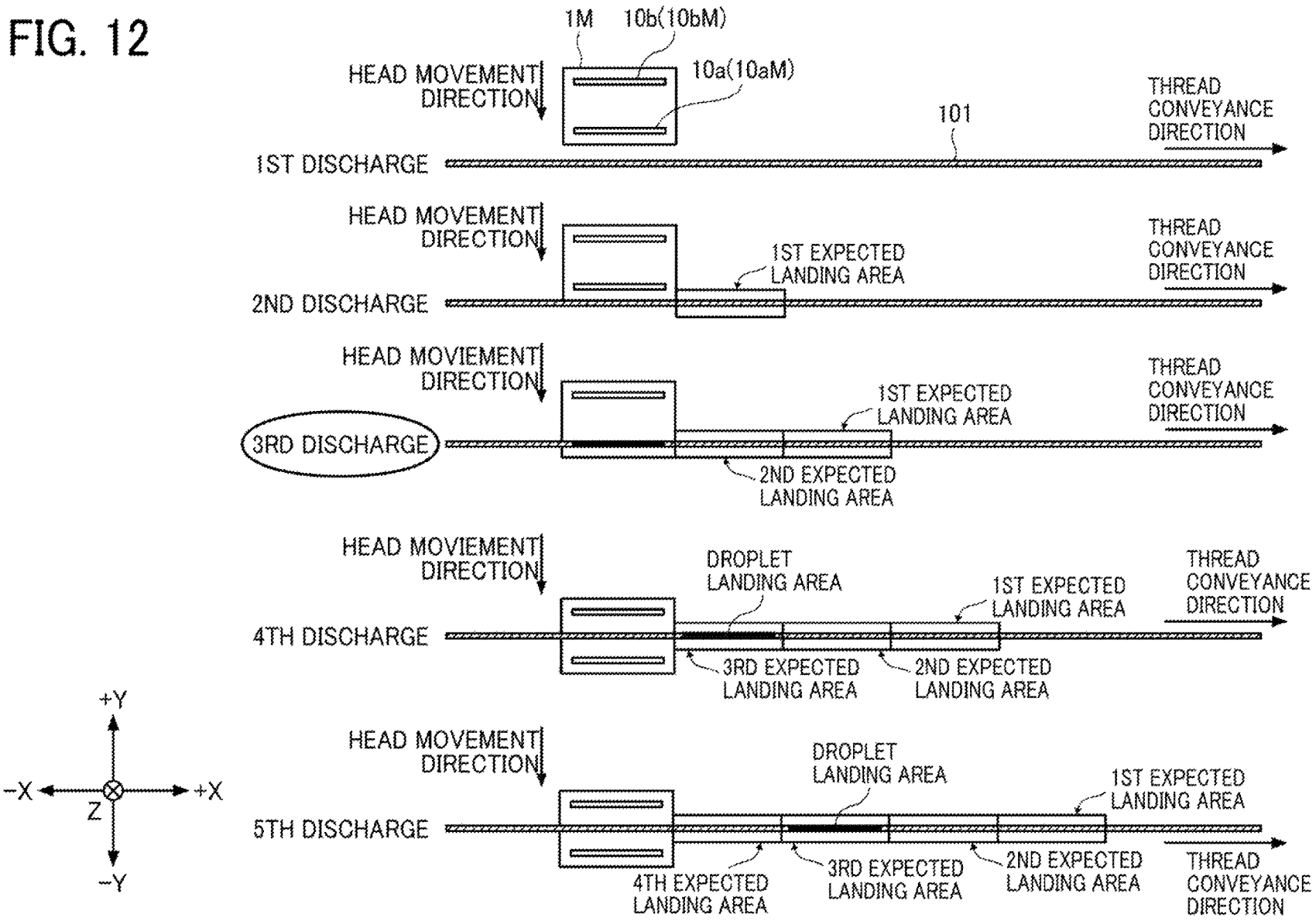
FIG. 12 is a diagram illustrating an example of the landing droplet on the thread in a case in which the discharge head is attached parallel to the thread.
Figure 13:
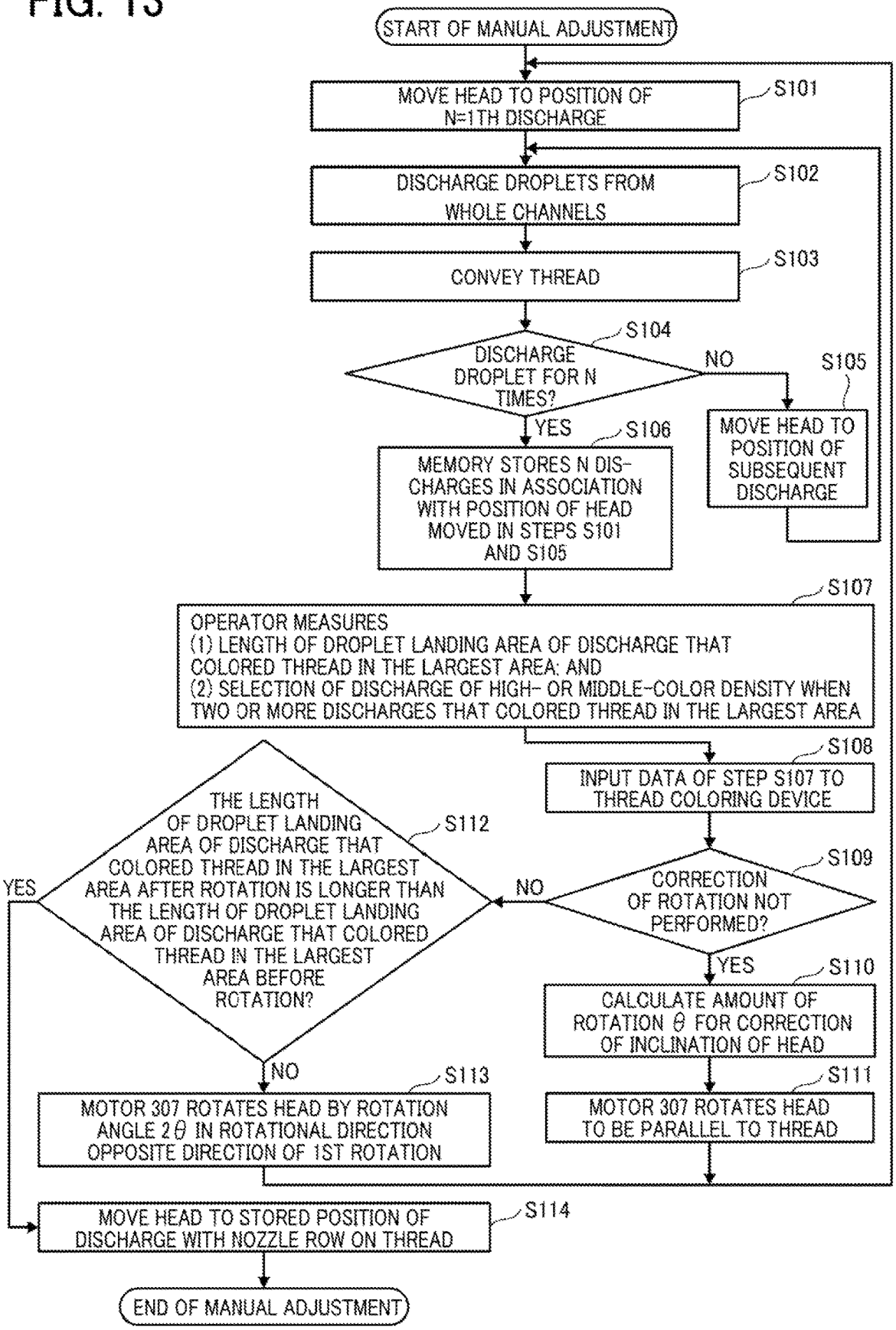
FIG. 13 is a flowchart of forming a pattern of landing droplets of the discharge head and adjusting the position of the discharge head, in Control Example 1 according to Embodiment 1 of the present disclosure.
Figure 14A:
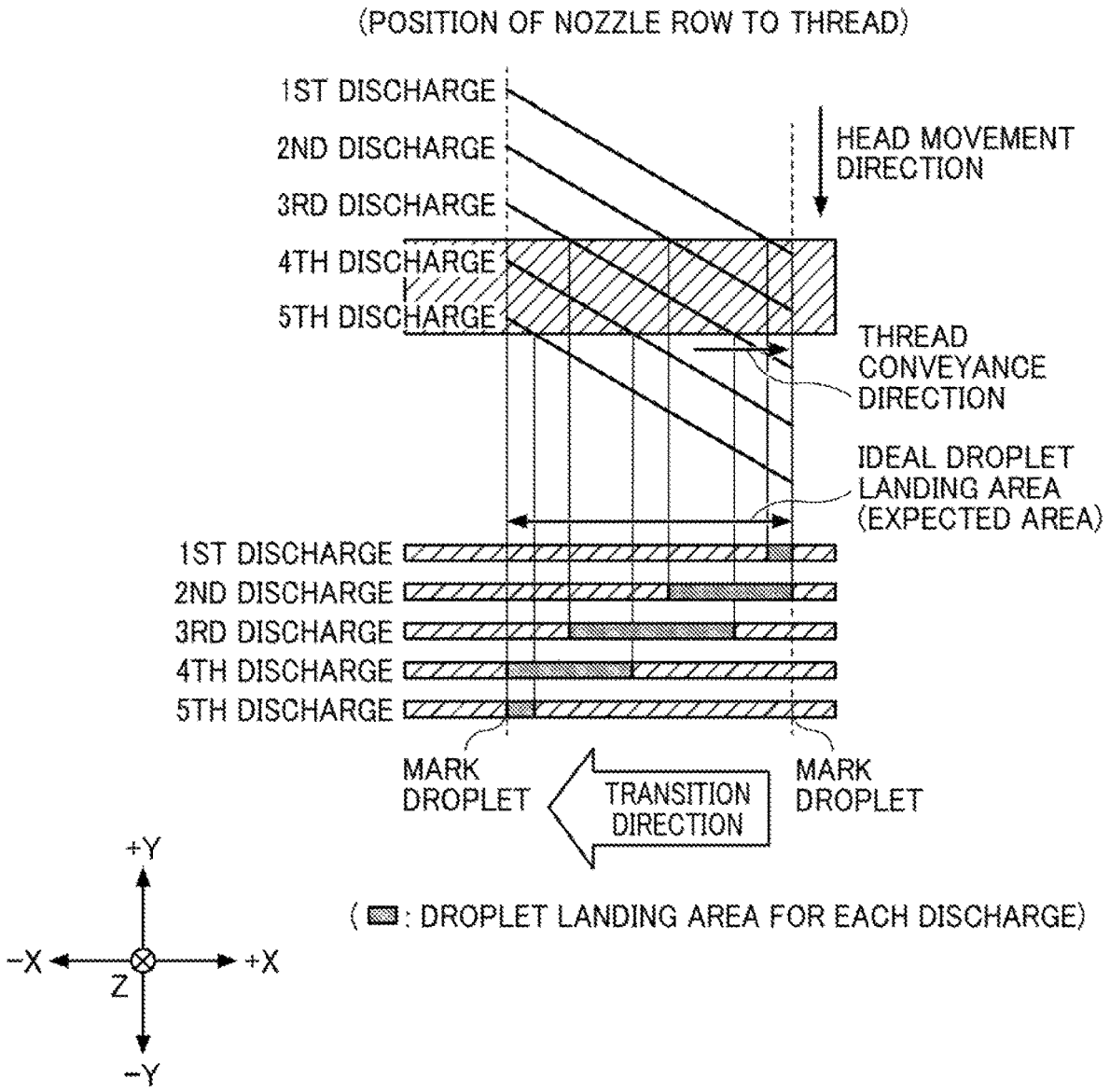
FIGS. 14A and 14B are diagrams illustrating arrangement of expected landing areas in section of the discharges as illustrated in FIG. 10, for each discharge.
Figure 14B:
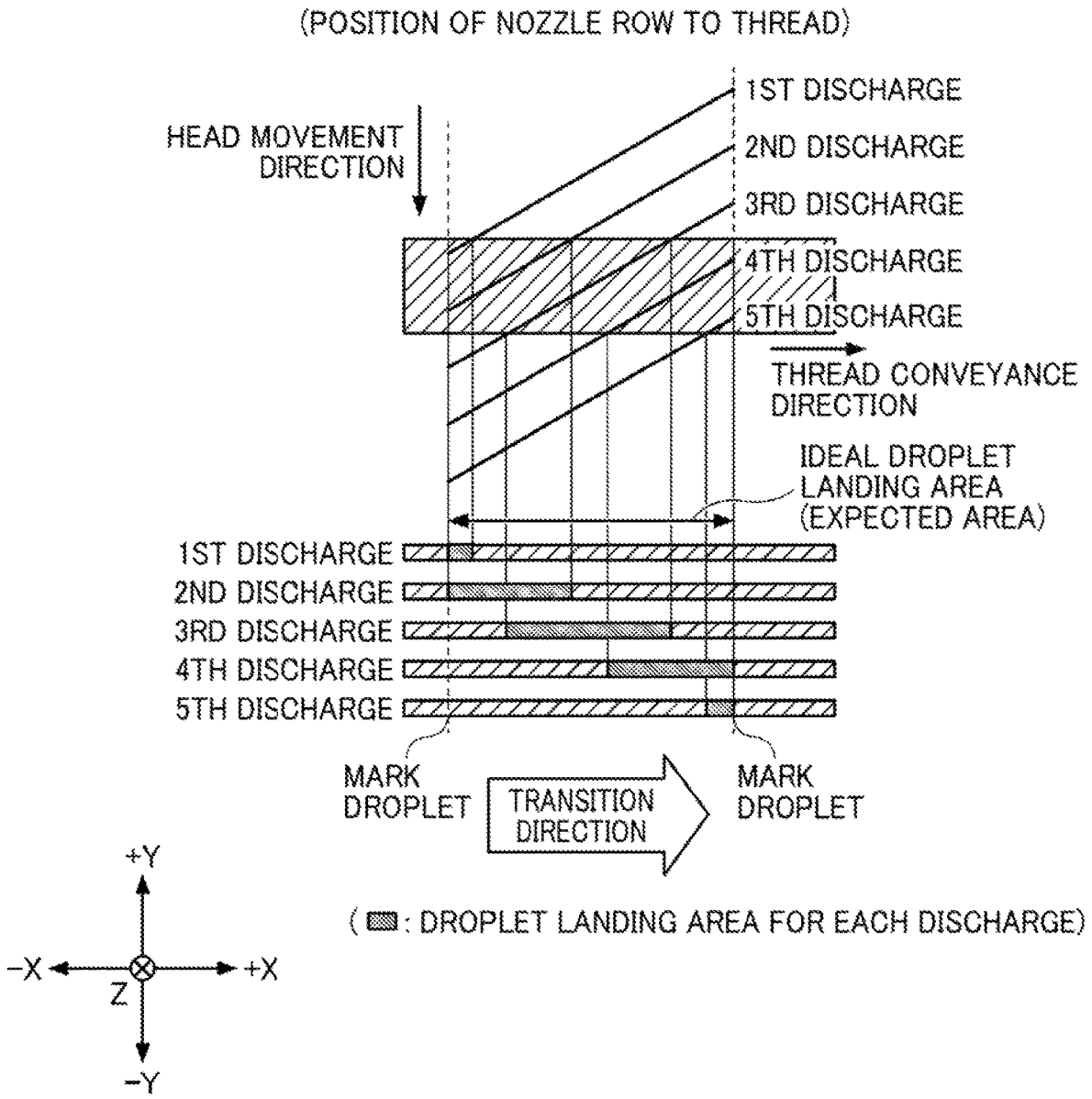

Note that, when the pattern group on the thread 101 is manually measured and input in the test, the ideal landing area on the thread 101 illustrated in FIGS. 12, 14A, and 14B is not specified correctly in the discharge head that is tested first among the plurality of discharge heads 1K, 1C, 1M, and 1Y. Therefore, in the flow of the manual measurement illustrated in the flowchart of FIG. 13, the first measurement fails to determine the direction of inclination of the discharge head 1K, that is, fails to determine whether the discharge head 1K is tilted toward the left side or the right side with respect to the thread conveyance direction.

In this case, the rotation motor 307K is moved to one direction (for example, the left direction) by a tilt angle θ, then the discharge head 1K discharges ink again to determine whether the inclination of the discharge head 1K is adjusted. To be more specific, the head discharges ink again to obtain the tilt angle θ again. When the tilt angle θ is zero (0), it is determined that the direction is matched, so that the parallel adjustment is completed. When the tilt angle θ is not zero (0), that is, when the inclination of the discharge head is not corrected, the discharge head is rotated by 2 times of the tilt angle θ and completes the parallel adjustment.

Note that, in this example, the rotation motors 307K, 307C, 307M, and 307Y rotate the discharge heads 1K, 1C, 1M, and 1Y, respectively. However, the discharge heads 1K, 1C, 1M, and 1Y may be rotated manually to correct the inclination of the discharge heads 1K, 1C, 1M, and 1Y to the thread 101.

Control Block

Figure 9:
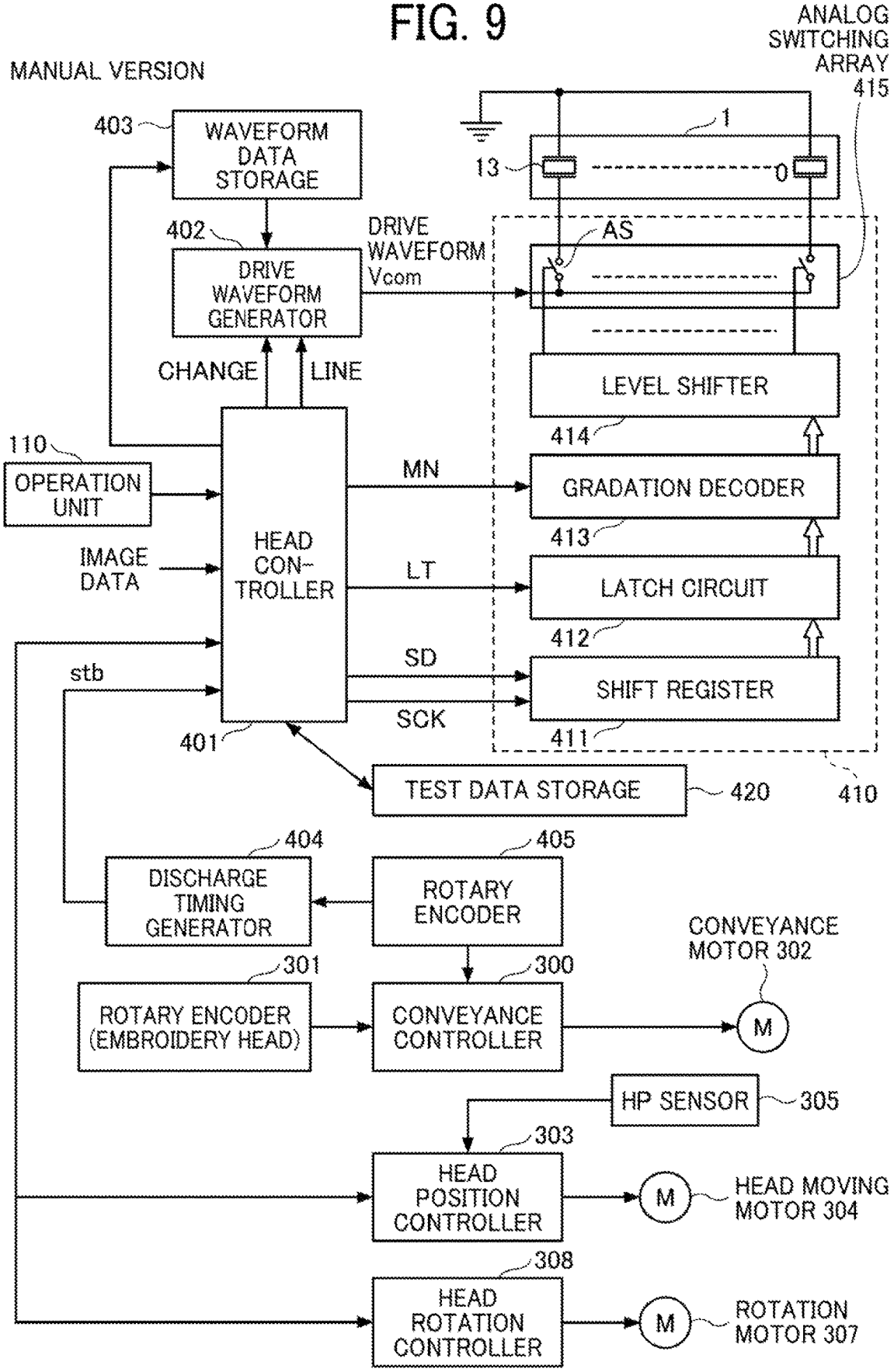
FIG. 9 is a control block diagram illustrating a part of liquid discharge and head adjustment performed in the liquid discharge apparatus according to Embodiment 1 of the present disclosure.

FIG. 9 is a control block diagram illustrating a part of liquid discharge and head adjustment performed in the liquid discharge apparatus according to Embodiment 1 of the present disclosure.

The discharge head 1 includes a plurality of piezoelectric elements 13 each functioning a pressure generation element that generates pressure to discharge liquid from the plurality of nozzles 11. A drive waveform applying unit to apply a drive waveform to the discharge head 1 is implemented by a head controller 401, a drive waveform generator 402, a waveform data storage 403, a head driver 410, and a discharge timing generator 404. The discharge timing generator 404 generates the liquid discharge timing.

Further, for example, a conveyance controller 300, the rotary encoder 405 of the conveyance roller 109, a rotary encoder 301 on the embroidery head side, and a conveyance motor 302 are provided as a conveyance control unit.

A head position controller 303, the head moving motor 304, and the HP sensor 305 are provided as a head position control unit.

Further, a colorimetry sensor 306 is provided to measure the length of the thread 101 on which ink is applied.

In response to receipt of a discharge timing pulse stb, the head controller 401 outputs a discharge sync signal LINE to the drive waveform generator 402. The discharge sync signal LINE triggers generation of a drive waveform. The head controller 401 also outputs a discharge timing signal CHANGE to the drive waveform generator 402. The discharge timing signal CHANGE corresponds to the amount of delay from the discharge sync signal LINE.

The drive waveform generator 402 generates a common drive waveform signal Vcom at the timing based on the discharge sync signal LINE and the discharge timing signal CHANGE.

The head controller 401 receives image data and generates a mask control signal MN based on the image data. The mask control signal MN is for selecting the predetermined waveform of the common drive waveform signal Vcom according to the size of the liquid droplet to be discharged from each nozzle 11 of the discharge head 1. The mask control signal MN is a signal at a timing synchronized with the discharge timing signal CHANGE.

Then, the head controller 401 transmits image data SD, a synchronization clock signal SCK, a latch signal LT instructing latch of the image data SD, and the generated mask control signal MN, to the head driver 410.

The head driver 410 includes a shift register 411, a latch circuit 412, a gradation decoder 413, a level shifter 414, and an analog switch array 415.

The shift register 411 receives the image data SD and the synchronization clock signal SCK transmitted from the head controller 401. The latch circuit 412 latches each registration value on the shift register 411 according to the latch signal LT transmitted from the head controller 401.

The gradation decoder 413 decodes the value (image data SD) latched by the latch circuit 412 and the mask control signal MN and outputs the result. The level shifter 414 performs level conversion of a logic level voltage signal of the gradation decoder 413 to an operable level of the analog switch AS of the analog switch array 415.

The analog switch AS of the analog switch array 415 is turned on and off by the output received from the gradation decoder 413 via the level shifter 414. The analog switch AS is provided for each nozzle 11 of the discharge head 1 and is connected to a separate electrode of the piezoelectric element 13 corresponding to each nozzle 11. In addition, the common drive waveform signal Vcom from the drive waveform generator 402 is input to the analog switch AS. In addition, as described above, the timing of the mask control signal MN is synchronized with the timing of the common drive waveform signal Vcom.

Therefore, the analog switch AS is switched between on and off timely in accordance with the output from the gradation decoder 413 via the level shifter 414. With this operation, the drive waveform to be applied to the piezoelectric element 13 corresponding to each nozzle 11 is selected from the drive waveforms constituting the common drive waveform signal Vcom. As a result, the size of the droplet discharged from the nozzle 11 is controlled.

The discharge timing generator 404 generates and outputs the discharge timing pulse stb each time the thread 101 is moved by a predetermined amount (distance), based on the detection result of the rotary encoder 405 that detects the number of rotations of the conveyance roller 109 illustrated in FIG. 1.

Here, the thread 101 is conveyed (fed) by being consumed due to the embroidery operation performed by the embroidery head 106 that is disposed downstream from the liquid discharge apparatus 100 in the thread conveyance direction. The rotary encoder 301 on the downstream side of the embroidery head 106 is a feed amount detector that detects the amount of movement of the thread 101 in the embroidery head 106.

Conveyance of the thread 101 rotates the conveyance roller 109 guiding the thread 101, so that the encoder wheel 405*a* of the rotary encoder 405 rotates to generate and output the encoder pulse in proportion to the linear velocity of the thread 101, from the encoder sensor 405*b*.

The discharge timing generator 404 generates the discharge timing pulse stb based on the encoder pulse from the rotary encoder 405. The discharge timing pulse stb is used as the discharge timing of the discharge head 1. Application of the liquid to the thread 101 is applied from when the thread 101 starts to move. Even if the linear velocity of the thread 101 changes, the intervals of the discharge timing pulses stb varies according to the encoder pulse, thereby preventing deviation of the landing position of a liquid droplet.

The conveyance controller 300 is an example of a conveyance control unit, determines the conveyance speed of the thread 101 based on the movement amount of the rotary encoder 301 on the downstream side, and rotates the conveyance roller 108 by the conveyance motor 302 to convey the thread 101 at the determined conveying speed. Further, the speed is detected with the rotary encoder 405 to control the thread conveyance of the conveyance motor 302.

The head position controller 303 is an example of a head position control unit, and rotates the head moving motor 304 based on a head position command from the head controller 401 to move the discharge heads 1K, 1C, 1M, and 1Y to predetermined positions.

For example, when the head moving motor 304 is a stepper motor, position control is performed by rotating the head moving motor 304 from a state in which the home position (HP) is detected by the HP sensor 305, by the number of steps corresponding to the distance from the HP to a target position such as the coloring position in the nozzle row 10*a*, the coloring position in the nozzle row 10*b*, or the capping position. The head position controller 303 notifies the head controller 401 that the head movement has been completed after the rotation by the number of steps corresponding to the distance is performed.

The head rotation controller 308 is an example of a head rotation control unit and rotates the (head) rotation motor 307 based on a head position command from the head controller 401 to rotate the discharge heads 1K, 1C, 1M, and 1Y The (head) rotation motor 307 is an example of a head inclination adjuster that rotates the discharge head in the horizontal direction and rotates based on the number of steps according to the angle of rotation. The head rotation controller 308 notifies the head controller 401 that the head movement has been completed after the rotation by the number of steps corresponding to the angle is performed.

In the present embodiment, the operation unit 110 is connected to the head controller 401. When an operator manually inputs the measurement data of the landing pattern group on the thread on the test of the discharge head, into the operation unit 110, and the head controller 401 receives the measurement data input by the operator, the head controller 401 stores the whole measurement data in the test data storage 420.

The head controller 401 selectively acquires data from the test data information stored in the test data storage 420 that functions as a memory, generates the head position command and the head rotation command to output to the head position controller 303 and the head rotation controller 308, respectively.

Detection of Inclination of Head

As illustrated in FIG. 5A through FIG. 8, the discharge heads 1K, 1C, 1M, and 1Y are freely movable at the capping position and the discharge position in the head movement direction and rotatable to the thread conveyance direction. However, while being freely movable, the discharge heads 1K, 1C, 1M, and 1Y are easy to have variation in the mechanical attaching position. If the head position to the thread is not matched, ink does not land on the thread correctly. Therefore, in the present disclosure, a test is conducted to adjust the position of the discharge head. Next, a description is given of the discharge method of the landing pattern group that includes droplets for the test of the position and inclination of the discharge head and the detection method of the landing pattern group.

Figure 10:
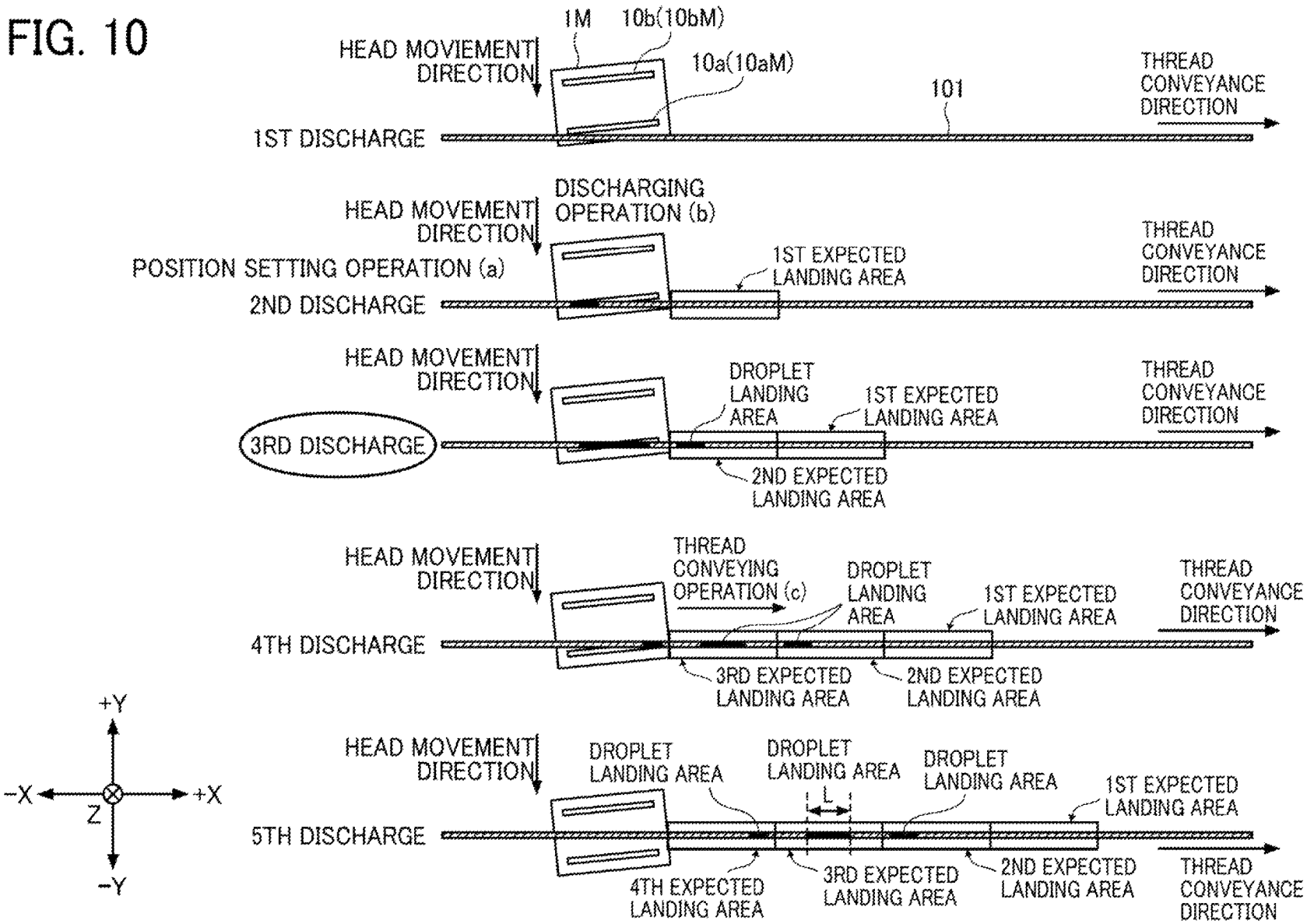
FIG. 10 is a diagram for explaining an example of landing droplets on the thread in a case in which the discharge head is not attached parallel to the thread.

FIG. 10 is a diagram for explaining the landing pattern group on the thread in a case in which the discharge head 1M is not attached parallel to the thread.

In FIG. 10, it is assumed that droplets are discharged from the nozzles of the nozzle row 10*a* of the discharge head 1M at any discharge time. Note that, in FIGS. 10, 11, 12, and 14, the discharge head 1M that discharges ink of magenta is explained as an example. However, the other heads 1K, 1C, and 1Y also discharge ink of black, cyan, and yellow in the test.

As illustrated in FIG. 10, as a discharge method for the test, the movement of the discharge head, the discharge of ink, and the thread conveyance are performed. To be more specific, the head moving device performs the position setting operation (a) to move the discharge head 1M to any position (position of each discharge) in the orthogonal direction. At the position in the orthogonal direction where the discharge head 1M is moved, the head moving device then performs the discharging operation (b) to discharge color droplets from the whole nozzles 11 of the nozzle row 10*a*, and then performs the conveying operation (c) to convey the thread 101 by the length of the nozzle row 10*a* or greater. The head moving device repeats the position setting operation (a), the discharging operation (b), and the conveying operation (c).

Here, in the position setting operation (a), if the amount of movement of the discharge head between the successive discharges is smaller than ½ of the thickness of the thread 101, the discharge head does not stride across the thread 101, and therefore does not fail to color the thread 101 at each discharge. Further, if the amount of movement of the discharge head between the successive discharges is equal to or smaller than ⅓ of the width of the thread 101, even if the inclination of the discharge head is relatively large, the change in the length of the landing droplet pattern of the droplets is confirmed. Therefore, it is more preferable that the amount of movement of the discharge head between the successive discharges is equal to or smaller than ⅓ of the thickness of the thread 101.

FIG. 10 illustrates the state when droplets are discharged from the whole nozzles. The number of nozzles to discharge ink simultaneously is not specified. However, to measure the length of the landing pattern, it is preferable ½ (50%) of the whole nozzles or more discharge ink simultaneously, so that the nozzle at the end and the nozzle at the center of the nozzle row 10*a* are included.

Consequently, the discharge head 1M repeats such a discharge operation from the nozzle row at each discharge for the predetermined times or until the discharge head 1M reaches a specified position, for example, a position at which the landing area on the thread is completely hidden. At this time, the test data storage 420 stores the whole data of the position in the head movement direction of the discharge head 1M and the number of discharges performed by the discharge head 1M. That is, the test data storage 420 stores the position of the discharge head 1M that is set in the position setting operation (a) in association with the discharge time at which the discharging operation are performed, by the number of repeats of the discharging operation.

Thereafter, a length L of the landing area (coloring area) on the thread for each expected landing area is measured visually or by a colorimetry sensor, and the discharge head 1M is rotated based on the length L of the landing area, thereby correcting the inclination of the discharge position of ink (droplet).

In FIG. 10, the landing pattern including a plurality of droplets that has reached the thread at the third discharge has the largest landing area of the thread. Therefore, the position of the landing area of the third discharge is set as the head position used for calculation of the tilt angle of the discharge head.

Calculation of Tilt Angle

Figure 11:
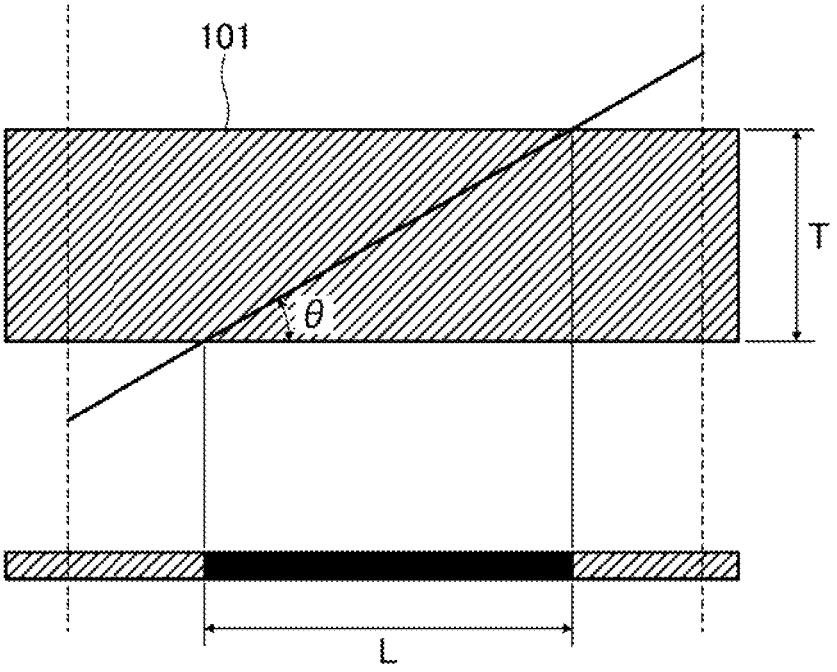
FIG. 11 is a diagram for explaining calculation of the tilt angle of the discharge head over the thread.

FIG. 11 is a diagram illustrating an example of a method of calculating the tilt angle of the discharge head. To be more specific, FIG. 11 is an enlarged view of the landing area on the thread on which droplets are discharged at the third discharge of FIG. 10.

In the landing droplets pattern group (plurality of colored areas, or landing area) actually landed on the thread, when the length L of the largest coloring area (landing area, landing droplet pattern) is measured visually or by a colorimetry sensor, the inclination of the discharge head is obtained with the following equation (Equation 1) using the thickness T of the thread.

$$\tan\theta = \frac{T}{L}. \quad \text{Equation 1}$$

By calculating the tilt angle of the discharge head as described above, even when the direction of inclination of the discharge head is not obtained, as the discharge head 1M is rotated by the amount of the tilt angle of the discharge head 1M, the inclination of the discharge head 1M is corrected with a ½ probability. In this case, if the direction of inclination of the discharge head is not correct, as the discharge head 1M is rotated again by twice of the amount of the tilt angle of the discharge head 1M in the reverse direction, the inclination of the discharge head 1M is adjusted correctly.

Note that a description of the direction of inclination of the discharge head is given below with reference to FIGS. 14A and 14B. However, since the direction of inclination of the discharge head is determined by the positional transition of the landing area, the amount of inclination of the discharge head and the direction of the discharge head is determined, based on the tilt angle of the discharge head and the direction of inclination of the discharge head, to adjust the inclination of the discharge head to be parallel with the thread conveyance direction of the thread. Therefore, when the tilt angle of the discharge head and the direction of inclination of the discharge head are already obtained, the length of the landing area is measured once, which completes the adjustment of inclination of the discharge head.

The tilt angle θ of the discharge head 1 is calculated according to FIGS. 10 and 11, the discharge head 1M is rotated by the tilt angle θ by the rotation motor 307K as illustrated in FIG. 8 to eliminate the inclination of the discharge head 1M. Thereafter, the position of the discharge head 1M is adjusted by the following method.

Note that, when the tilt angle θ of the discharge head 1M is calculated as zero (0) by the method indicated in FIGS. 10 and 11, the discharge head 1M does not rotate but shifts to the following positional adjustment of the discharge head 1 based on the landing droplet pattern group discharged from the discharge head.

Selection of Head Position

FIG. 12 is a diagram illustrating an example of the landing droplet pattern group on the thread (discharge example) in a case in which the discharge head is attached parallel to the thread.

In FIG. 12, it is assumed that droplets are discharged from the nozzles of the nozzle row 10*a* of the discharge head 1M at any discharge time.

Further, in this discharge method for the test, the movement of the discharge head, the discharge of ink, and the thread conveyance are performed. To be more specific, the head moving device performs the position setting operation (a) to move the discharge head 1M to any position (position of the first discharge) in the orthogonal direction. At the position in the orthogonal direction where the discharge head 1M is moved, the head moving device then performs the discharging operation (b) to discharge color droplets from the whole nozzles 11 of the nozzle row 10*a*, and then performs the conveying operation (c) to convey the thread 101 by the length of the nozzle row 10*a* or greater. The head moving device performs a repeating operation to repeat the position setting operation (a), the discharging operation (b), and the conveying operation (c).

Then, the discharge head 1M repeats such a discharge operation from the nozzle row at each discharge for the predetermined times or until the discharge head 1M reaches a specified position, for example, a position at which the landing area on the thread is completely hidden. At this time, the test data storage 420 stores the whole data of the position in the head movement direction of the discharge head 1M and the number of discharges performed by the discharge head 1M. That is, the test data storage 420 stores the whole data of the position of the discharge head 1M that is set in the position setting operation (a) (i.e., the position in the Y direction) in association with the discharge time at which the discharging operation is performed, by the number of repeats of the discharging operation.

Thereafter, whether there is a landing area on the thread and the density of the landing area are measured visually or by a colorimetry sensor, which is described below. In FIG. 12, the landing droplet pattern is formed on the thread for the third discharge alone. Therefore, the discharge head 1 is moved to the position where the third discharge is performed.

As described above, the head position adjustment is performed to move the discharge head at the head position that is stored that the discharge was correctly performed, thereby correcting the positional deviation of ink discharge to the thread.

Similarly, in this discharge operation, the amount of movement of the discharge head between the successive discharges is smaller than ½ of the thickness of the thread 101 in the position setting operation (a) in which the position of the discharge head is set. Accordingly, the discharge head does not stride across the thread 101, and therefore does not fail to color the thread 101 at each discharge.

Further, if the amount of movement of the discharge head between the successive discharges is equal to or smaller than ⅓ of the thickness of the thread 101, the landing droplet pattern is formed on the thread at two or more discharges. In this case, the discharge head is moved to the position of the discharge in which the thread was colored in the highest density. Note that, in a case in which the landing droplet patterns are formed on the thread with three successive discharges, the middle discharge that has formed the middle landing droplet pattern on the thread by the three successive discharges is selected. Further, the middle discharge may be applied when the landing droplet patterns are formed on the thread with three or more odd number discharges.

As the amount of movement of the discharge head between the discharges becomes narrower toward the thread 101, the head position is adjusted more correctly. Therefore, when coloring the thread, the droplets are discharged more evenly over the whole area of the thickness T of the thread.

Note that, in the present example, the thread has been described as the discharge target medium, but the discharge target medium onto which liquid is discharged may be another linear or strip-shaped medium having a narrow width and continuing in the thread conveyance direction. In the present disclosure, it is assumed that one color is dyed in one discharge in the width direction of a discharge target medium other than the thread, for example, a linear discharge target medium or a strip-shaped discharge target medium.

Then, in the test for the position and inclination of the discharge head described above, the position of the discharge head from which droplets are discharged is changed in the width direction of the discharge target medium, then the discharge head discharges the droplets for a plurality of times, and it is determined whether the landing droplets are formed on the discharge target medium at each discharge visually or by a sensor described below.

Therefore, the liquid discharge apparatus according to the present disclosure employs a discharge target medium having a relatively narrow width, so that, for example, when the liquid droplet used form the head position adjustment is discharged from each nozzle and lands on the discharge target medium to bleed over at least ½ or more of the width of the discharge target medium, more preferably, to bleed over substantially the whole widthwise area of the discharge target medium.

Flowchart of Embodiment 1

FIG. 13 is a flowchart of forming the landing droplet pattern of the discharge head and adjusting the position of the discharge head, (in Control Example 1) according to Embodiment 1 of the present disclosure.

In step S101, the discharge head 1 that is a test target object is moved to the position where the first discharge is started. This position may or may not be the home position (HP) of the discharge head 1. However, the position is set to allow the discharge head to move to stride across the thread when the discharge is repeated from the first discharge to the N-th discharge. That is, the head position setting operation is performed in step S101.

In S102, droplets of a color to be adjusted are discharged from the whole nozzles of the discharge head of the color. That is, the discharge operation is performed in step S102.

In S103, the thread 101 is conveyed to a position at which a portion of the thread 101 with no landing droplets (no landing droplet portion) comes below the discharge head 1. In order to make the no landing droplet portion of the thread 101 come below the discharge head 1, the thread 101 is conveyed by a distance equal to or greater than the length of the nozzle row, in step S103. That is, the medium conveyance operation is performed in step S103.

At this time, the amount of conveyance of the thread 101 may be constant at equal intervals from the first discharge to the N-th discharge or may be changed. When the amount of conveyance of the thread 101 is changed, the amount of conveyance of the thread 101 is stored from the data of the rotary encoder 405 to clarify at which position and at which discharge time the coloring operation is performed on the thread 101.

In S104, it is determined whether the discharge operation is performed up to the final discharge and whether the discharge operation is performed by the predetermined discharge times. When the discharge operation is not performed up to the final discharge (NO in step S104), the process moves to step S105. The final discharge (N-th discharge) is freely set and may be controlled based on the number of pulses of the motor or may be controlled based on the position.

In S105, the discharge head 1 is moved to the subsequent discharge position. The amount of movement of the discharge head 1 may be controlled based on the number of pulses of the motor or based on the position. That is, the position setting operation is performed in step S105.

By performing the first operation in steps S101 to S105, the plurality of landing droplet patterns is formed on the thread 101 as illustrated in FIG. 10.

In step S06, the test data storage 420 stores the position of the discharge head 1M that is moved in steps S101 and 105 (any position of the discharge head set in the position setting operation in association with the discharge time at which the discharging operation are performed (any of 1 to N), by N times (the number of repeats of the discharging operation). That is, the test data storage 420 stores the whole data of the position of the discharge head and the number of discharges performed by the discharge head, performed in steps S104 and S105.

In step S107, the operator measures the landing droplet pattern of each discharge, which is a result of coloring the thread. The measurement is performed on the length L of the landing area (coloring area) of the discharge that has colored the thread in the largest landing area. Here, the operator may measure the length of the landing area with a scale or may capture the image around the landing area by the camera online or offline to allow the camera to measure the length of the landing area.

Here, if the discharge that has colored the thread in the largest areas is not visually determined, the middle discharge out of the discharges that have colored the thread may be determined as the discharge that has colored in the thread in the largest area. Specifically, it is assumed that the discharges are repeated for 10 times (N=10) and that the 6th, 7th, and 8th discharges have colored the thread. In this case, the 7th discharge may be determined as the discharge that has colored the thread in the largest area.

In step S108, the operator inputs the data about which discharge measured in step S106 has colored the thread in the largest area and the length L of the landing area, to the operation unit 110 of the thread coloring-embroidering apparatus 1000 or to an external personal computer (PC) (that corresponds to the external information processing device 200) that is connected to the thread coloring-embroidering apparatus 1000. This data may be stored in the thread coloring-embroidering apparatus 1000 or in the external PC (that corresponds to the external information processing device 200).

In step S109, it is determined whether the rotation of the discharge head 1 is corrected. In any case, it is confirmed whether the rotation of the discharge head 1 is corrected before correcting the position of the discharge head.

In step S110, the angle of the discharge head that is deviated with respect to the thread is determined based on the data input in step S107. The angle of rotation of the discharge head at this time is calculated by the method described in FIGS. 11 and 12.

In step S111, the rotation motor 307 rotates the discharge head 1 based on the amount of rotation θ calculated in step S110. Then, the operation forming the second landing droplet pattern group is performed. After adjustment of the inclination of the discharge head 1, the operations in steps S101 to S105 for the second time or the third times are performed to form the plurality of landing droplet patterns as illustrated in FIG. 12, on the thread 101.

Similar to the first time, after the landing droplet pattern group is formed and stored in steps S101 to S105 and the measurement and input performed by the operator in steps S107 and S108 are finished, when the result of step S109 is NO, the process proceeds to step S112. In step S112, it is determined whether the length of the coloring area on the thread colored by the discharge that has colored the thread in the largest area after the rotation of the discharge head 1 is longer than the length of the coloring area on the thread colored by the discharge that has colored the thread in the largest area before the rotation of the discharge head 1.

Here, when the length of the coloring area on the thread colored by the discharge that has colored the thread in the largest area after the rotation of the discharge head 1 is equal to or shorter than the length of the coloring area on the thread colored by the discharge that has colored the thread in the largest area before the rotation of the discharge head 1 (NO in step S112), it is determined that the rotation of the discharge head performed in step S111 was performed in the opposite direction, that is, the discharge head was rotated in the direction that was not correct.

In this case, in step S113, the discharge head 1 is rotated by the amount twice the amount of rotation θ of the discharge head of the first rotation, in the reverse direction that is opposite the rotational direction of the discharge head in step S111.

On the other hand, when the length of the coloring area on the thread after the rotation of the discharge head 1 is longer than the length of the coloring area on the thread before the rotation of the discharge head 1 (YES in step S112), the discharge head is moved to the position at which the discharge that has colored the thread in the largest area was performed, the position being input in step S107 at the second time, in step S114. After step S114, the flow of the flowchart in FIG. 13 is completed.

In this control example, it is not determined whether the discharge head 1 is tilted to the left side or the right side, with respect to the thread conveyance direction of the thread 101. However, the rotation motor 307 is rotated to one direction (for example, the left direction) by the tilt angle θ first, then the discharge head 1 discharges ink again, so as to determine whether the inclination of the discharge head 1 is adjusted.

Then, the discharge head discharges ink again to obtain the tilt angle θ again. When the tilt angle θ that is obtained by the method of FIGS. 10 and 11 is zero (0), it is determined that the direction is matched, so that the parallel adjustment is completed. By contrast, when the tilt angle θ is not zero (0), that is, when the inclination of the discharge head is not corrected, the discharge head is rotated by 2 times of the tilt angle θ and completes the parallel adjustment. Therefore, the probability that the result of step S112 is YES is ½ (50%).

As described above, in the present embodiment, ink is discharged, and the thread is conveyed while gradually moving the discharge head by the technique of correcting the position of the discharge head with respect to the thread. By repeating these operations, an operator grasps the optimum position of the discharge head. Accordingly, the landing position of the droplet discharged from the discharge head to the thread is adjusted.

Detection of Head Inclination Direction by Detection of Positional Transition of Landing Area In the flow in the flowchart of FIG. 13, since the direction of inclination of the discharge head was not obtained, the discharge head was rotated to correct the tilt angle (amount of rotation θ) calculated with a probability of ½ (50%). However, if the direction of inclination of the discharge head is obtained, the inclination of the discharge head is corrected by one rotation of the discharge head. Here, the following description is given of the method of detecting the direction of inclination of the discharge head, in reference with FIGS. 14A and 14B.

FIGS. 14A and 14B are diagrams illustrating expected droplet landing areas discharged on the thread, separating each liquid discharge, in a case in which the discharge head is not attached in parallel with the thread. That is, FIGS. 14A and 14B are diagrams, each illustrating arrangement of the ideal landing areas (expected landing areas) in section of FIG. 10, taken for each discharge.

Specifically, in FIGS. 14A and 14B, the upper part is a top view of the position of the nozzle row with respect to the thread when the discharge head is attached obliquely with respect to the head movement direction, and the lower part is a view of the transition of the coloring areas (landing areas) of the thread at that time.

As described in FIGS. 10 and 11, the accuracy of the mechanical attachment is poor, and even when the discharge head is attached obliquely, i.e., at an angle, the length of the coloring area is measured, so that the position of the discharge head may be moved based on the result of the measurement.

Then, the direction of inclination of the discharge head is determined based on whether the actual coloring area (landing area) is changed to the thread conveyance direction (+X direction) or the thread winding direction (−X direction) with respect to the position of the nozzles.

To be more specific, the positional transition is detected to indicate how the position of the landing area on the thread changes through the plurality of measured discharges as the number of discharges increases, with respect to the ideal position of the landing area (expected landing area) to which droplets are discharged on the thread at the plurality of discharges performed wile the discharge head 1 is correctly set.

Accordingly, the head controller 401 determines the direction of inclination of the discharge head to the conveyance direction of a linear object, based on the data of this positional transition of the landing area.

Specifically, as illustrated in FIG. 14A, when the measured landing area transitions to the opposite side (−X direction) of the thread conveyance direction with respect to the ideal landing area (expected landing area), the downstream end of the discharge head 1 in the thread conveyance direction is tilted to the left side with respect to the thread conveyance direction.

On the other hand, as illustrated in FIG. 14B, when the measured landing area transitions to the opposite side (+X direction) of the thread conveyance direction with respect to the ideal landing area (expected landing area), the downstream end of the discharge head 1 in the thread conveyance direction is tilted to the right side with respect to the thread conveyance direction.

Here, in order to obtain the position of the landing area as illustrated in FIGS. 14A and 14B, the range of the ideal landing area (expected landing area) on the thread needs to be obtained. Therefore, when the detection is performed by the operator, it is preferable to use a head of another color for which the test has already been completed and cause the discharge head to discharge droplets (for example, N+1 droplets) each serving as a mark (mark droplet), at intervals of the length of the ideal landing area to define the ideal landing area.

Note that, in the above-described example in reference with FIGS. 13, 14A, and 14B, the measurement is performed with a scale. However, the same flow as the above-described example may be applied when an operator manually measures with the offline colorimetry sensor that is not on the conveyance passage while holding the offline colorimetry sensor in hand.

However, when the liquid discharge apparatus is an inline-type apparatus in which the colorimetry sensor is previously provided, the flow is performed further automatically. Next, a description is given of the configuration of an inline-type liquid discharge apparatus provided with a colorimetry sensor.

Embodiment 2: Automatic Sensing

Figure 15A:
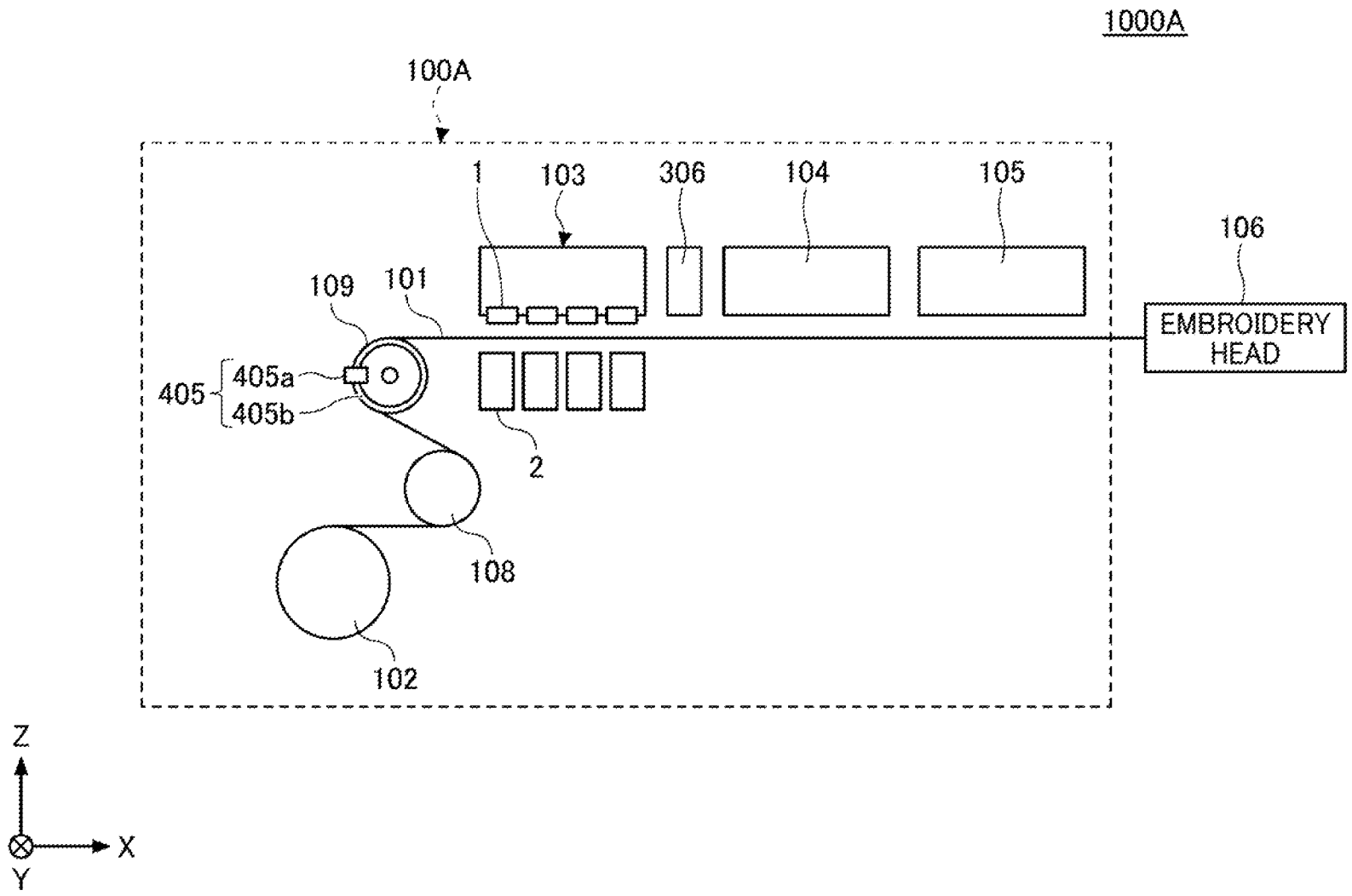
FIGS. 15A and 15B are side views each illustrating an example of a coloring-embroidering application including the liquid discharge apparatus in which a sensor according to Embodiment 2 of the present disclosure is embedded.
Figure 15B:
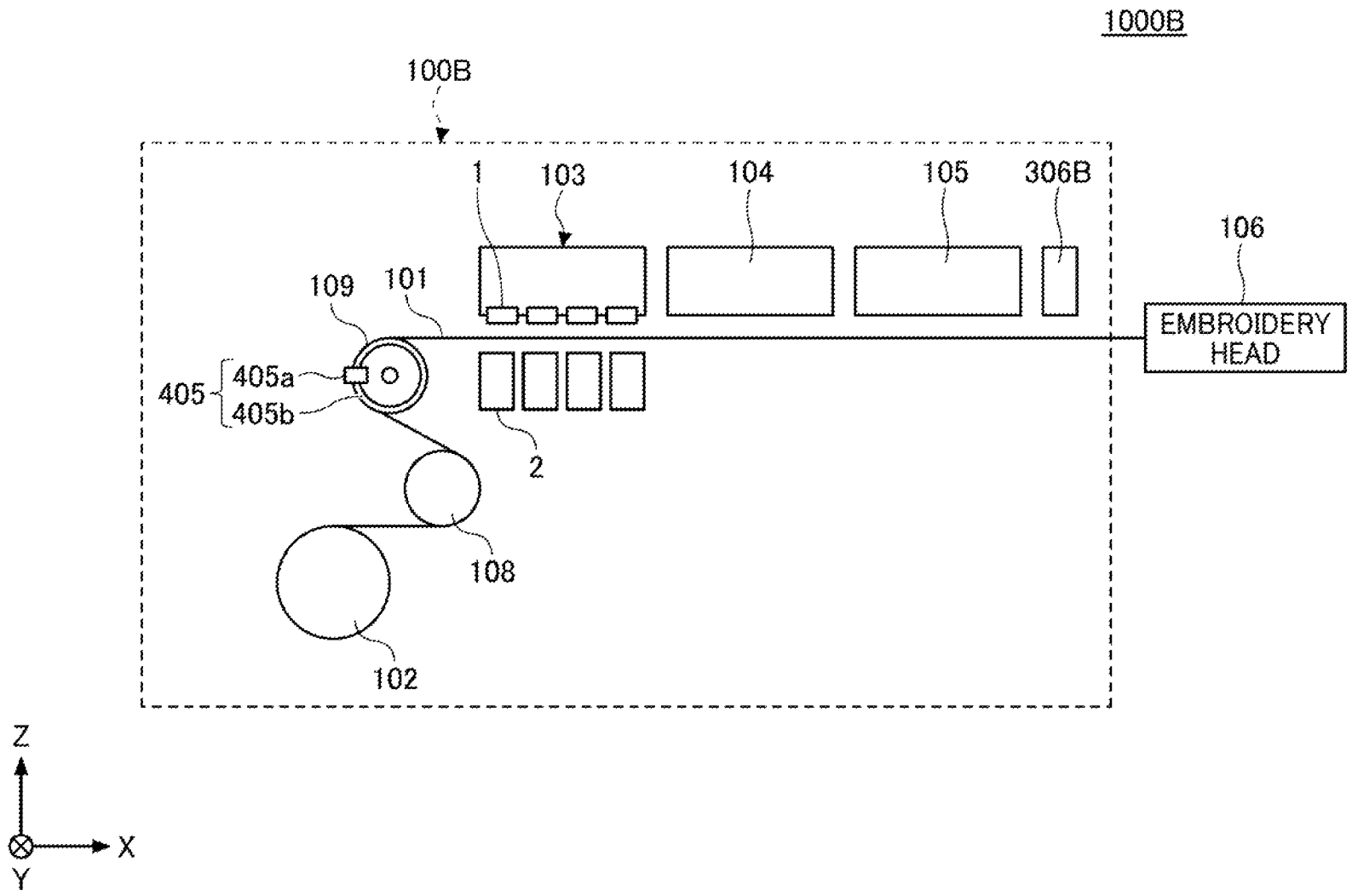

FIGS. 15A and 15B are side views each illustrating an example of a thread coloring-embroidering apparatus including the liquid discharge apparatus in which a sensor according to Embodiment 2 of the present disclosure is provided.

In a thread coloring-embroidering apparatus 1000A illustrated in FIG. 15A and a thread coloring-embroidering apparatus 1000B illustrated in FIG. 15B, the colorimetry sensor 306 is disposed downstream from the discharge head 1 of the liquid applying device 103 in the thread conveyance direction to detect a plurality of test patterns of landing droplets (the group of test patterns of landing droplets) on the thread.

For an example, as illustrated in FIG. 15A, the liquid discharge apparatus 100A includes the colorimetry sensor 306 disposed immediately downstream from the liquid applying device 103 in the thread conveyance direction. Further, as long as the colorimetry sensor 306 is disposed downstream from the liquid applying device 103 in the thread conveyance direction, the position of the colorimetry sensor 306 may not be disposed immediately downstream from the liquid applying device 103 in the thread conveyance direction.

Therefore, as the liquid discharge apparatus 100B illustrated in FIG. 15B, a colorimetry sensor 306B may be disposed downstream from the fixing device 104 and the post-processing device 105 in the thread conveyance direction. Alternatively, a colorimetry sensor may be disposed between the fixing device 104 and the post-processing device 105 in the thread conveyance direction.

The colorimetry sensor 306 is disposed downstream from the discharge heads 1K, 1C, 1M, and 1Y in the thread conveyance direction. After the coloring operation on the thread 101, the colorimetry sensor 306 starts detecting the colored portions. Then, while the thread 101 is conveyed, the colorimetry sensor 306 measures the length L of the landing area. The measurement is determined based on the distance of conveyance of the thread 101 according to the number of rotations of the rotary encoder 405.

Then, when the colorimetry sensor 306 reaches and detects the area in which the thread 101 is not colored again, the count of the number of rotations of the rotary encoder 405 is stopped to complete the measurement by the colorimetry sensor 306.

Figure 16:
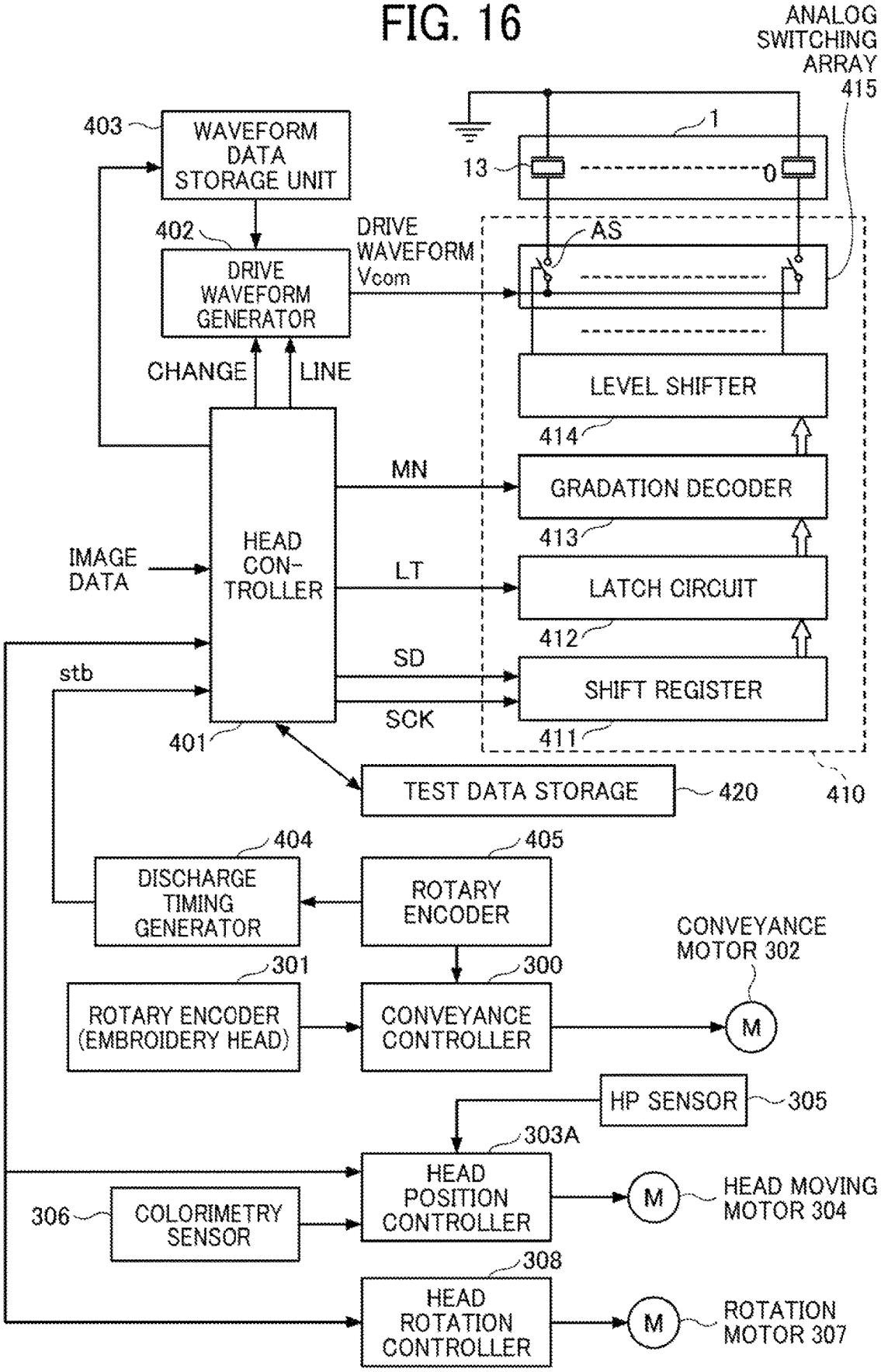
FIG. 16 is a control block diagram illustrating a part of liquid discharge and head adjustment performed in the liquid discharge apparatus according to Embodiment 2 of the present disclosure.

FIG. 16 is a control block diagram illustrating a part of liquid discharge and head adjustment performed in the liquid discharge apparatus according to Embodiment 2 of the present disclosure.

The colorimetry sensor 306 that functions as a detector is disposed downstream from the discharge heads 1 (that is, the discharge heads 1K, 1C, 1M, and 1Y) in the thread conveyance direction. The colorimetry sensor 306 measures the length of the landing area that is an ink area of the discharged ink that has colored the thread 101. The length L measured by the colorimetry sensor 306 is maintained in the head position controller 303A and used as a parameter when the head position is adjusted so that the nozzle row 10*a* of the discharge head 1 is located directly above the thread 101.

Therefore, in the present embodiment, when the test is conducted to detect on the thread 101, the colorimetry sensor 306 measures the length of the landing position on the thread, the positional transition of the landing area on the thread 101, and the color density of the landing area on the thread 101.

Accordingly, the head position controller 303A calculates the amount of rotation of the discharge head 1 (the number of rotations θ of the discharge head 1, in other words, the tilt angle θ) to the conveyance direction of the thread 101, based on the length L of the largest landing area on the linear object in the discharge of the plurality of discharges measured by the colorimetry sensor 306, and the thickness T of the thread 101.

To be more specific, in the present embodiment, the head position controller 303A detects the positional transition that indicates how the position of the landing area on the thread 101 changes through the plurality of discharges measured by the colorimetry sensor 306 as the number of discharges increases, with respect to the ideal landing position of the landing area (expected landing area) to which droplets are discharged on the thread 101 at the plurality of discharges performed while the discharge head 1 is correctly set without the mark from the other heads 1. Accordingly, the head position controller 303A determines the direction of inclination of the discharge head 1 to the conveyance direction of the thread, based on the transition of the coloring position of the coloring area at the plurality of discharges.

Further, the colorimetry sensor 306 performs a density comparison. Therefore, when there are largest landing areas at two or more discharges, in other words, there are two or more discharges each having the largest landing area on the thread, the head moving device selects the discharge having the highest color density on the thread 101 among the plurality of discharges based on the color density data obtained by the colorimetry sensor 306 and moves the discharge head 1 to the position in the orthogonal direction to the thread conveyance direction at the discharge having the highest color density.

Flowchart of Embodiment 2

Figure 17:
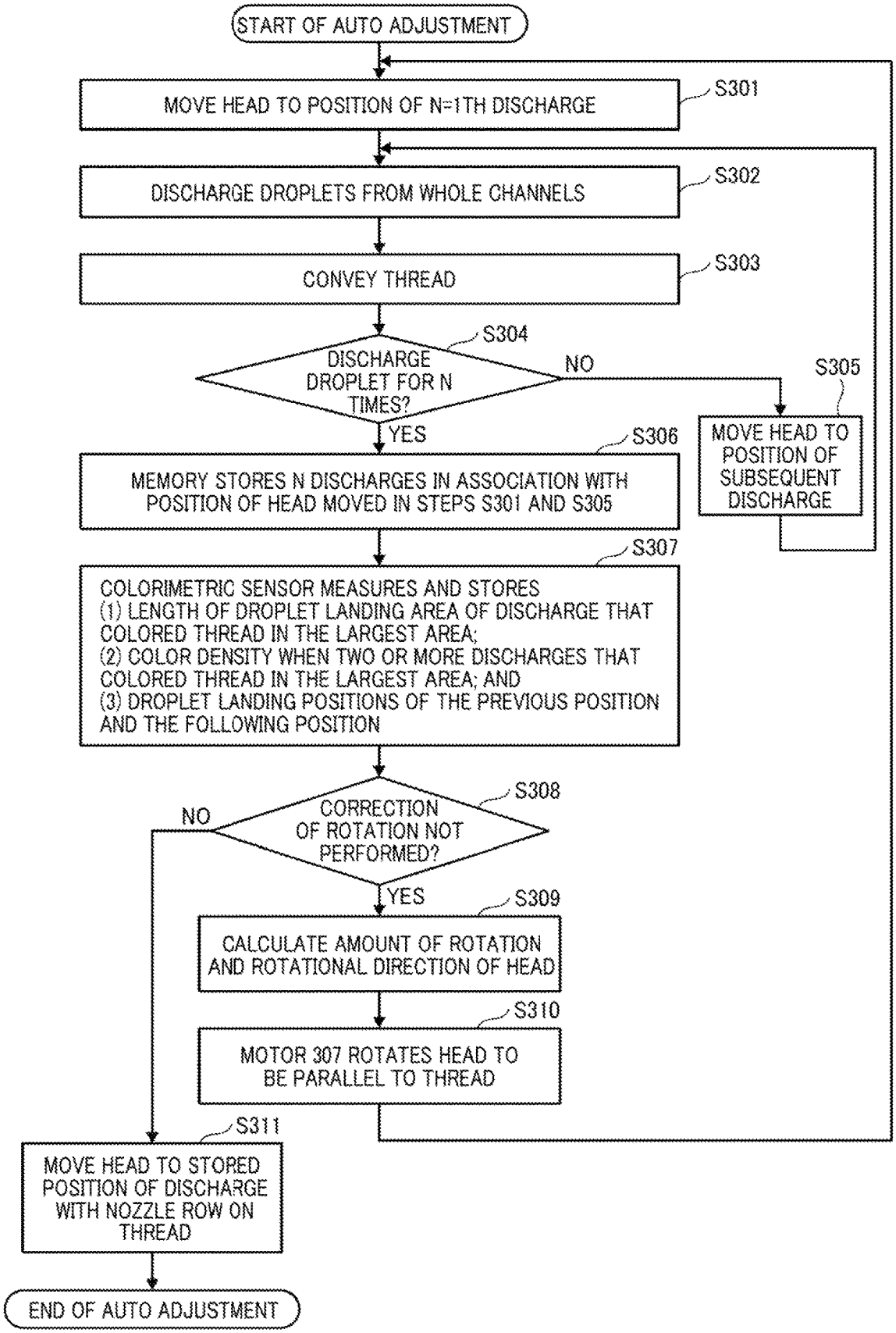
FIG. 17 is a flowchart of forming a pattern of landing droplets of the discharge head and adjusting the position of the discharge head, according to Embodiment 2 of the present disclosure.

FIG. 17 is a flowchart illustrating a control flow in the liquid discharge apparatus according to Embodiment 2 of the present disclosure.

Now, a description is given of the control executed in Embodiment 2, except for the same operations performed in Embodiment 1 illustrated in FIG. 13. To be more specific, steps S301 to S306 in the flowchart of FIG. 17 are same as steps S101 to S106 in the flowchart of FIG. 13 and steps S308, S309, S310, and S311 in the flowchart of FIG. 17 correspond to steps S109, S110, S111, and S114 in the flowchart of FIG. 13, respectively.

In step S307, the colorimetry sensor 306 measures the result of coloring on the thread 101 and stores the result in the liquid discharge apparatus 100A (or the liquid discharge apparatus 100B). The colorimetry sensor 306 measures the length of the coloring area at the N-th discharge that colored the largest landing area and detects the direction of transition of the coloring position (landing position).

Note that, since the colorimetry sensor 306 automatically sends the measurement result to the head position controller 303A, the head controller 401, or both, a manual input process in step S108 is not performed.

Then, in S309, the length of the largest coloring area on which the thread 101 is colored and the transition of the coloring positions at a plurality of discharge times are grasped to calculate the rotational direction to correct the direction of inclination of the discharge head 1 in addition to the amount of rotation θ.

In the present embodiment, the liquid discharge apparatus repeats ink discharge while gradually moving the discharge head 1 and conveyance of the thread. At the same time, the liquid discharge apparatus detects the landing droplet pattern by the colorimetry sensor 306 and detects to detect the landing droplet pattern and detects the amount of conveyance of the thread 101 according to the number of rotations of the rotary encoder 405. By so doing, the head controller 401 or the head position controller 303A grasps the landing position of the droplets discharged from the discharge head 1 to the thread 101 that functions as a linear object and adjusts the discharge head 1 according to the position.

As described above, in this flow, by providing the colorimetry sensor 306, after the length, density, and direction of transition of color are determined, whether there is a coloring area and the density of the coloring area are determined. Since these determinations are made, an operator who measures the length of the coloring area and selects the number of discharges is not required, and therefore the test of the discharge head, correction of the rotation of the discharge head, and correction of the movement of the discharge head are automatically performed.

Accordingly, since the test is conducted automatically, formation of the landing droplet pattern for the above-described test and adjustment of the angle and position of the discharge head are performed between the coloring operations performed by the coloring apparatus, for example, after decapping. Therefore, the frequency of test of the discharge head and adjustment of the position of the discharge head is increased easily, which further increases the quality of landing of the droplets from the discharge head onto the thread.

Other Coloring Apparatus

Figure 18:
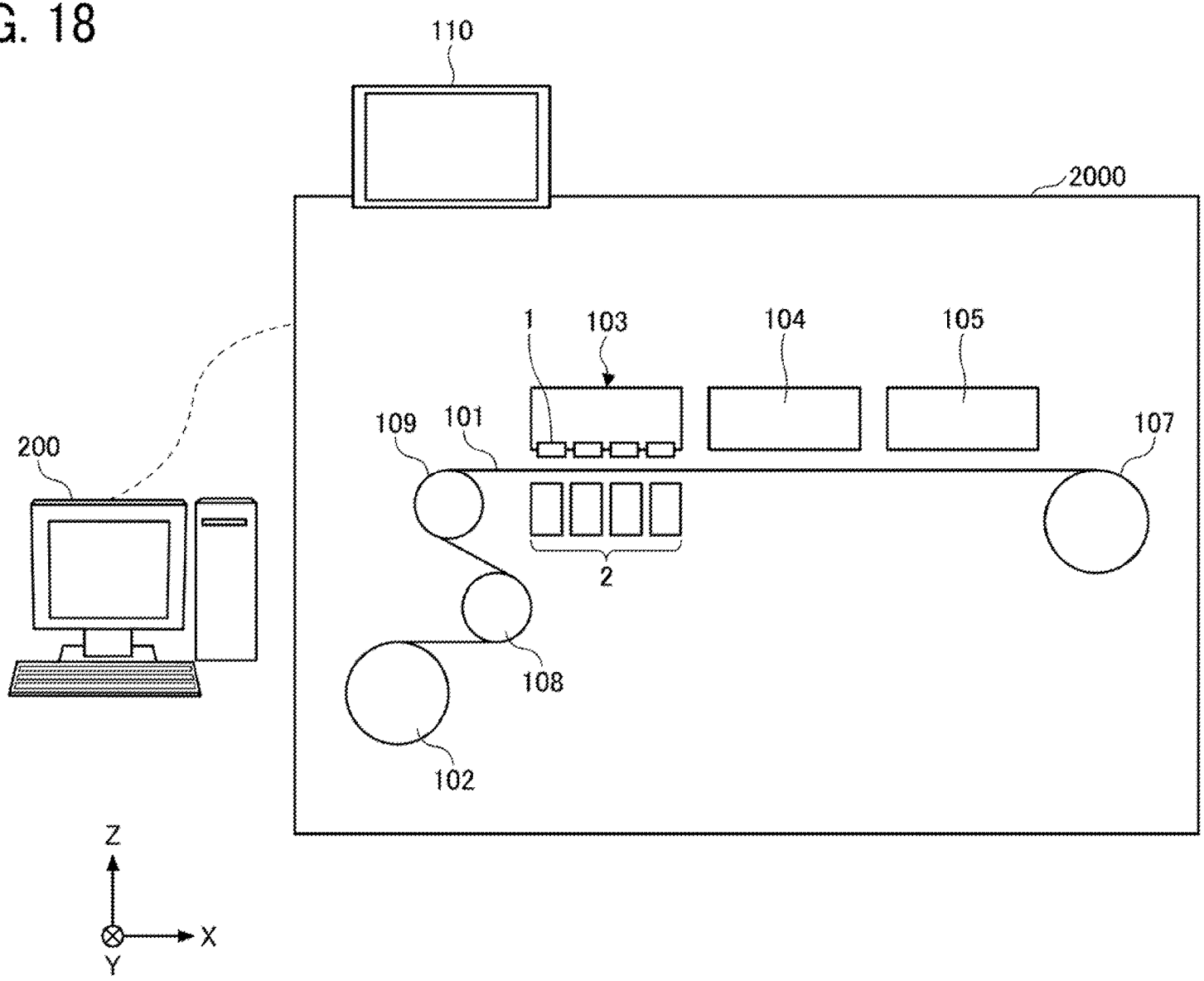
FIG. 18 is a schematic view illustrating an example of a thread coloring system incorporating a liquid discharge apparatus according to an embodiment of the present disclosure.

Next, a description is given of another example of a liquid discharge apparatus according to an embodiment of the present disclosure with reference to FIG. 18.

FIG. 18 is a schematic view illustrating an example of a coloring system 2000 incorporating a liquid discharge apparatus according to an embodiment of the present disclosure.

The coloring system 2000 basically has the configuration identical to the configuration of the thread coloring-embroidering apparatus 1000 illustrated in FIG. 1, except that the coloring system 2000 includes a thread winding reel 107 to wind the colored thread 101 while the thread coloring-embroidering apparatus 1000 of FIG. 1 includes the embroidery head 106.

In the coloring system 2000, the thread supplying reel 102 supplies the thread 101, the liquid applying device 103 discharges and supplies liquid of a specified color to the thread 101 to color the thread 101 to the specified color, and the thread winding reel 107 winds the colored thread 101.

The coloring system 2000 is also provided with an operation unit 110. Alternatively, an external personal computer (PC) 200 that functions as an information processing device may be connected to the housing of the coloring system 2000.

Also in the coloring system 2000, while gradually moving the discharge head using the technique of correcting the positional deviation of the discharge head to the thread by the control using the colorimetric sensor according to Embodiment 1 or Embodiment 2, ink is discharged and the thread is conveyed. By repeating the ink discharge and the conveyance of the thread, the position of the discharge head with respect to the linear object as an ink discharge target is accurately grasped. Then, by adjusting the inclination and position of the discharge head, the landing position of the droplet to be discharged from the discharge head to the linear-shaped discharge target medium is adjusted.

Note that the liquid discharge apparatus according to the above-described embodiments includes the discharge head that discharges liquid toward downward, the cap is disposed below the discharge head, and the face of the nozzle plate is covered from below. However, the discharge direction of ink droplets by the discharge head is not limited to the downward direction. For example, ink droplets may be discharged in the upward direction or in the horizontal (lateral) direction. Alternatively, a plurality of liquid discharge heads is disposed on the drum to discharge liquid (ink) in a direction outwardly away from the center of rotation. In any configuration, the cap is disposed at a position facing the liquid discharge direction of the discharge head or at a position facing the position to which the discharge head is moved from the liquid discharge position. In this configuration, an image sensor may be disposed downstream from the discharge head in the thread conveyance direction, at a position at which the landing droplet that lands on the surface of the thread is detected.

Although the present disclosure makes reference to specific embodiments, it is to be noted that the present disclosure is not limited to the details of the embodiments and examples described above. For example, elements and/or features of different embodiments and examples may be combined with each other and/or substituted for each other within the scope of the present disclosure. The number of constituent elements and their locations, shapes, and so forth are not limited to any of the structure for performing the methodology illustrated in the drawings. Further, the present disclosure is not limited to the embodiments and examples described above. Thus, various modifications and enhancements are possible in light of the above teachings, without departing from the scope of the present disclosure.

Note that the present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the present disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A liquid discharge apparatus comprising:

a discharge head having a nozzle row in which a plurality of nozzles are arranged to discharge a liquid;

a conveyor configured to convey a discharge target medium in parallel with a direction of arrangement of the nozzle row of the discharge head;

a head mover configured to move the discharge head in an orthogonal direction to a medium conveyance direction of the discharge target medium;

a head rotator configured to rotate the discharge head about an axial direction in which the liquid is discharged from each nozzle; and circuitry configured to move and rotate the discharge head, the circuitry being configured to perform:

a position setting operation to cause the head mover to move the discharge head to a position in the orthogonal direction;

a discharging operation to cause the discharge head to discharge a liquid from each nozzle of the nozzle row of the discharge head at the position to which the discharge head is moved by the position setting operation;

a medium conveying operation to cause the conveyor to convey the discharge target medium by a distance equal to or greater than a length of the nozzle row; and a changing operation to cause the head mover to change the position of the discharge head set in the position setting operation, the circuitry being configured to cause the head rotator to rotate the discharge head based on a length of a landing area of droplets of the liquid landed on the discharge target medium by the position setting operation, the discharging operation, the medium conveying operation, and the changing operation.

2. The liquid discharge apparatus according to claim 1, further comprising a memory configured to store the position of the discharge head set in the position setting operation in association with a discharge at which the discharging operation is performed, by a number of repeats of the changing operation, wherein the circuitry is configured to cause the head rotator to rotate the discharge head, based on a length of a largest landing area on the discharge target medium at a discharge among a plurality of discharges, as the landing area of droplets landed on the discharge target medium by the position setting operation, the discharging operation, the medium conveying operation, and the changing operation, to correct inclination of the discharge head with respect to the medium conveyance direction of the discharge target medium.

3. The liquid discharge apparatus according to claim 2, wherein the circuitry is configured to, after the inclination of the discharge head is corrected, perform the position setting operation, the discharge operation, and the medium conveying operation again and cause the memory to store the position again, and wherein the head mover is configured to move the discharge head to the position in the orthogonal direction at a discharge having a largest landing area on the discharge target medium, among a plurality of discharges stored in the memory.

4. The liquid discharge apparatus according to claim 3, wherein, the head mover is configured to cause the discharge head to move to the position in the orthogonal direction at a discharge having a highest color density on the discharge target medium when two or more discharges each have the largest landing area on the discharge target medium, among the plurality of discharges, and wherein the head mover is configured to cause the discharge head to move to the position in the orthogonal direction at a discharge in a middle of the plurality of discharges when three or more odd number discharges each have the largest landing area on the discharge target medium among the plurality of discharges.

5. The liquid discharge apparatus according to claim 2, further comprising an interface portion to which data is input, wherein the droplet is a color droplet, and wherein the circuitry is configured to acquire data from the interface portion and calculate a tilt angle of the discharge head with respect to the medium conveyance direction of the discharge target medium, based on a length of the largest landing area on the discharge target medium at a discharge among the plurality of discharges input to the interface portion and a thickness of the discharge target medium.

6. The liquid discharge apparatus according to claim 5, wherein the head rotator is configured to rotate the discharge head, based on the tilt angle of the discharge head calculated by the circuitry.

7. The liquid discharge apparatus according to claim 1, further comprising a detector disposed downstream from the discharge head in the medium conveyance direction of the discharge target medium, the detector being configured to detect a state of droplets landed on the discharge target medium, wherein the detector is configured to measure the length of the landing area, a landing position, and a color density of droplets landed on the discharge target medium when the detector detects the state of droplets landed on the discharge target medium.

8. The liquid discharge apparatus according to claim 7, further comprising another controller configured to acquire data from the detector, wherein said another controller is configured to:

detect a transition that indicates how a position of the landing area on the discharge target medium changes through the plurality of discharges measured by the detector as a number of discharges increases, with respect to an ideal position of the landing area to which droplets are discharged on the discharge target medium at the plurality of discharges performed while the discharge head is correctly set; and determine a direction of inclination of the discharge head to the medium conveyance direction of the discharge target medium, based on the transition of the position of the landing area at the plurality of discharges.

9. The liquid discharge apparatus according to claim 7, wherein the circuitry is configured to acquire data from the detector and calculate a tilt angle of the discharge head with respect to the medium conveyance direction of the discharge target medium, based on a thickness of the discharge target medium and a length of the landing area of droplets landed on the discharge target medium by the position setting operation, the discharging operation, the medium conveying operation, and the changing operation measured by the detector.

10. The liquid discharge apparatus according to claim 9, wherein the head rotator is configured to rotate the discharge head, based on a direction of inclination of the discharge head and the tilt angle of the discharge head, both calculated by the circuitry, to correct the inclination of the discharge head.

11. The liquid discharge apparatus according to claim 1, further comprising:

a plurality of discharge heads configured to discharge different colors from each other; and an interface portion configured to receive data that is input manually by an operator, wherein the circuitry is configured to acquire data from the interface portion, and wherein the circuitry is configured to cause a tested discharge head of the plurality of discharge heads to discharge N+1 mark droplets of a color different from a color of a discharge head to be tested out of the plurality of discharge heads, at each interval of a length of an ideal landing area of droplets from the discharge head that is correctly set; and determine a direction of inclination of the discharge head to the medium conveyance direction of the discharge target medium, as the interface portion receives the data of a length of a landing position on the discharge target medium and the landing position at each discharge through the plurality of discharges in a test, with respect to an ideal length of the landing area to which droplets are discharged on the discharge target medium at the plurality of discharges detected by the operator while the discharge head that is correctly set.

12. A method for adjusting a discharge head in a liquid discharge apparatus that includes the discharge head, a conveyor, a head mover, and a head rotator, the method comprising:

moving the discharge head with the head mover to a position in an orthogonal direction to a medium conveyance direction of a discharge target medium;

discharging the liquid from each nozzle of a nozzle row of the discharge head at the position to which the discharge head is moved by the moving;

conveying the discharge target medium with the conveyor by a distance equal to or greater than a length of the nozzle row;

changing, with the head mover, the position of the discharge head set in the moving; and rotating the discharge head with the head rotator, based on a length of a droplet landing area of droplets of the liquid landed on the discharge target medium by the moving, the discharging, the conveying, and the changing.

* * * * *